US006548454B1

(12) United States Patent
Yamamoto et al.

(10) Patent No.: US 6,548,454 B1
(45) Date of Patent: Apr. 15, 2003

(54) ROLLING APPARATUS CONTAINING A LIQUID FLUORINATED POLYMER OIL AND THICKENING AGENT

(75) Inventors: Toyohisa Yamamoto, Kanagawa (JP); Atsuhiro Yamamoto, Kanagawa (JP); Atsushi Yokouchi, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/141,566

(22) Filed: Aug. 28, 1998

(30) Foreign Application Priority Data

| | | |
|---|---|---|
| Aug. 29, 1997 | (JP) | 9-234244 |
| Jan. 5, 1998 | (JP) | 10-000386 |
| Jul. 29, 1998 | (JP) | 10-213963 |
| Jul. 29, 1998 | (JP) | 10-213964 |

(51) Int. Cl.[7] ..... C10M 169/02

(52) U.S. Cl. ..... 508/138; 508/154; 508/156; 508/172; 508/181; 508/182; 508/447; 508/448; 508/469; 508/474; 508/517; 508/509; 508/582; 508/590; 384/13

(58) Field of Search ..... 508/138, 165, 508/172, 181, 182, 448, 469, 474, 582, 590, 154, 447, 509, 517; 384/13

(56) References Cited

U.S. PATENT DOCUMENTS

| | | | | | |
|---|---|---|---|---|---|
| 3,639,237 | A | | 2/1972 | Curtis | |
| 3,788,987 | A | * | 1/1974 | Bartlett | 508/590 |
| 5,000,864 | A | * | 3/1991 | Strepparola et al. | 508/582 |
| 5,124,058 | A | * | 6/1992 | Corti et al. | 508/582 |
| 5,435,927 | A | * | 7/1995 | Beckwith et al. | 508/582 |
| 5,840,666 | A | * | 11/1998 | Yokouchi et al. | 508/107 |
| 6,329,195 | B1 | * | 5/2001 | Suzuki et al. | |

FOREIGN PATENT DOCUMENTS

| | | |
|---|---|---|
| EP | 0322916 A1 | 5/1989 |
| EP | 0648832 A1 | 4/1995 |
| WO | WO 94/23223 | 10/1994 |

* cited by examiner

*Primary Examiner*—Jerry D. Johnson
(74) *Attorney, Agent, or Firm*—Crowell & Moring LLP

(57) ABSTRACT

The present invention provides a rolling apparatus comprising a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of (1) a thickening agent which is at least one selected from the group consisting of a solid fluoropolymer, a lamellar mineral powder, an ultrafinely particulate organic material, an organic solid lubricant and an ultrafinely particulate inorganic material, and (2) a base oil comprising a liquid fluorinated polymer oil.

19 Claims, 10 Drawing Sheets

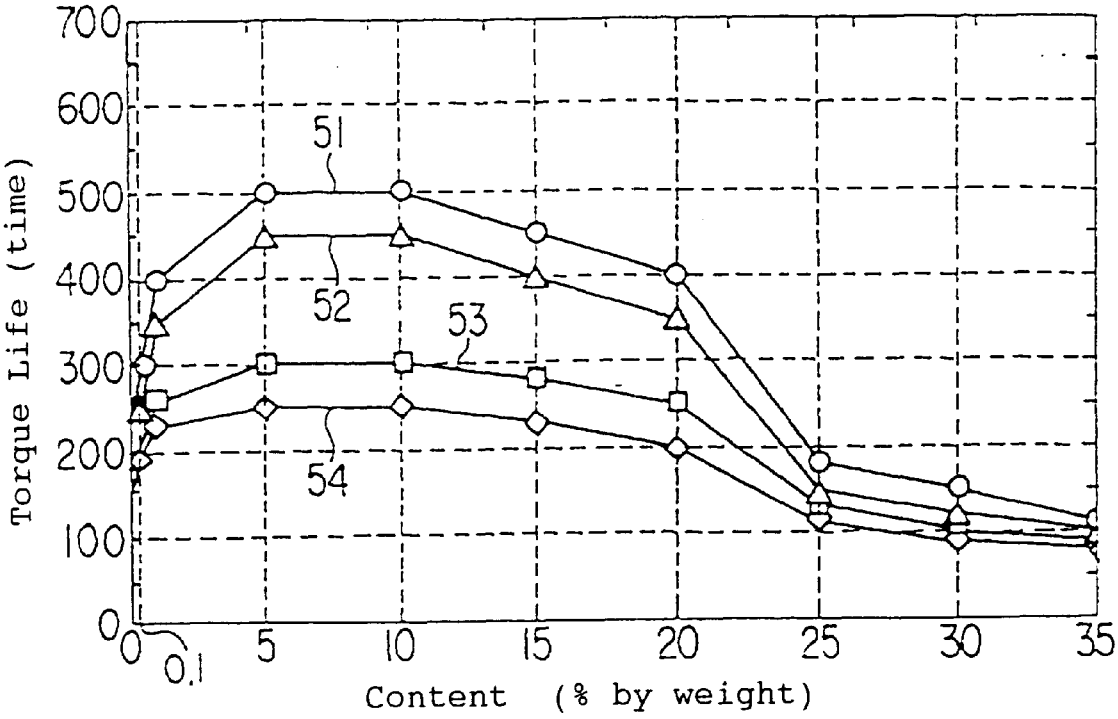
Fig. 6
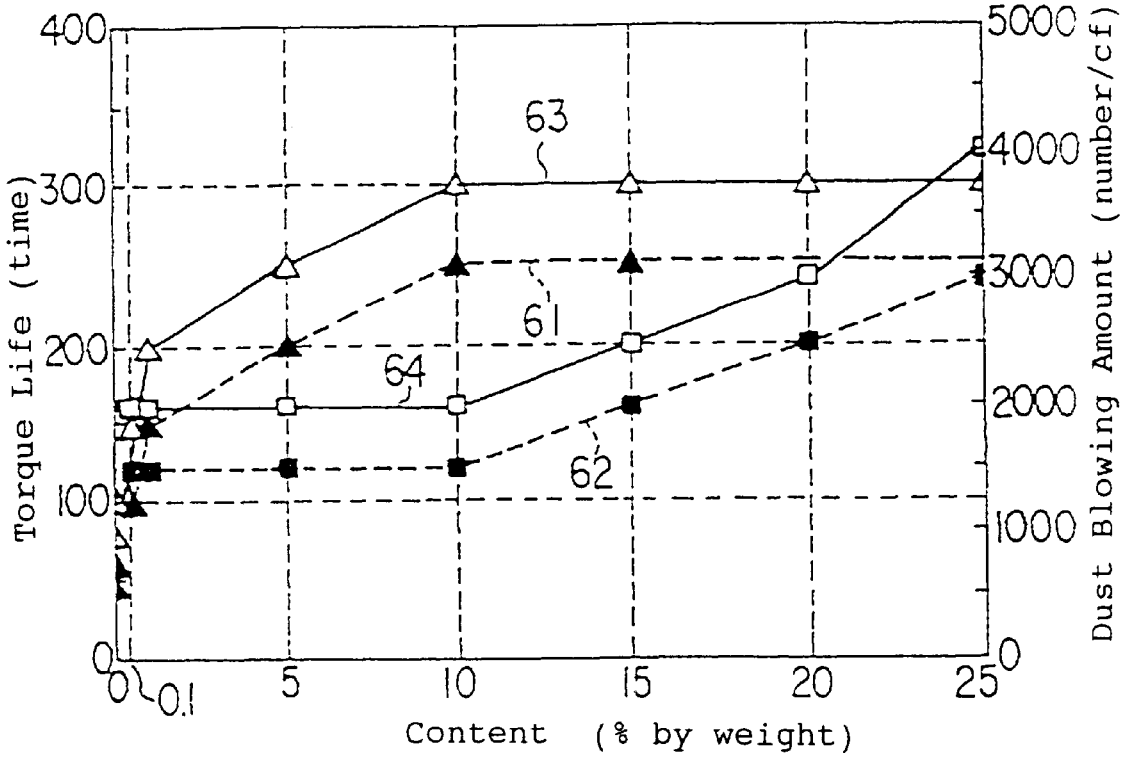

ROLLING APPARATUS CONTAINING A LIQUID FLUORINATED POLYMER OIL AND THICKENING AGENT

FIELD OF THE INVENTION

The present invention relates to a rolling apparatus and more particularly to a rolling apparatus comprising a lubricant composition.

BACKGROUND OF THE INVENTION

In general, a rolling apparatus such as rolling bearing and direct-acting apparatus comprises a lubricating oil such as mineral oil and poly-α-olefin oil or a lubricant such as grease enclosed in a circulating apparatus or thereinside to effect lubrication and thereby protect itself and members in contact therewith against abrasion or other damage.

Such a rolling apparatus can be used without any problems under normal working conditions. However, when such a rolling apparatus is used under high temperature conditions, reduced pressure or high speed conditions, the lubricant or grease is scattered out of the rolling apparatus or evaporated to produce a gas, causing contamination of the external atmosphere of the rolling apparatus. Therefore, a fluorine-based grease has heretofore been often used as a lubricant for rolling apparatus for uses requiring clean atmosphere such as clean room, semiconductor producing machine, liquid crystal panel producing machine and hard disc producing machine and apparatus which are used under high temperature conditions or under reduced pressure.

The fluorine-based grease is a mixture of a base oil composed of liquid fluorinated polymer oil and a thickening agent composed of solid fluorinated polymer. Because of its extremely low volatility, the fluorine-based grease is scattered out of the rolling apparatus in a relatively small amount (blown-up amount). Accordingly, the fluorine-based grease can cause relatively little contamination of the external atmosphere of the rolling apparatus.

However, this fluorine-based grease is inferior to the grease comprising a lubricating oil such as mineral oil and poly-α-olefin in fluidity and lubricity. Thus, when a rolling apparatus comprising such a fluorine-based grease is operated, it is liable to cause abrasion on the rolling elements and members in contact therewith. This abrasion is a serious problem particularly with a direct-acting apparatus for use in positioning apparatus in semiconductor or liquid crystal panel producing apparatuses because it deteriorates the positioning accuracy.

Further, dust produced by this abrasion enters in the lubricant, possibly causing torque fluctuations or torque rise or seizing in a relatively short period of time. This torque rise causes deterioration of positioning accuracy or heat generation or overload on a motor.

In recent years, the operation speed of semiconductor or liquid crystal panel producing machines has been raised more and more. Accordingly, it has been required for rolling apparatuses to operate at high speed. Therefore, these rolling apparatuses are more liable to torque rise due to dust blowing or abrasion caused by the lubricant scattering. It has thus been desired to minimize dust blowing and improve torque life.

As an approach for solving these problems there has been known a method involving the use of a lubricant comprising molybdenum disulfide, tungsten disulfide or graphite incorporated therein. The use of such a lubricant makes it possible to improve the load resistance, seizing resistance or boundary lubricity of the rolling apparatus.

However, since molybdenum disulfide or graphite is black, it can color an object to be treated such as a liquid crystal panel and a semiconductor substrate when the lubricant is scattered. Further, molybdenum disulfide and tungsten disulfide contains metallic elements such as molybdenum and tungsten. Therefore, when the lubricant is scattered, the metallic elements incorporated in the lubricant are attached to the object to be treated such as a semiconductor substrate, possibly causing troubles such as defects and short-circuiting.

SUMMARY OF THE INVENTION

An object of the present invention is to provide a rolling apparatus which exhibits reduced dust blowing and prolonged torque life, more specifically, a rolling apparatus which is suitable for use in an apparatus requiring a clean atmosphere such as clean room, semiconductor producing apparatus, liquid crystal panel producing apparatus and hard disc producing apparatus and exhibits minimized dust blowing and prolonged torque life at high temperatures, in vacuo or under other severe conditions.

Another object of the present invention is to provide a rolling apparatus which exhibits minimized dust blowing and prolonged torque life and causes no troubles on an object to be treated such as a liquid crystal panel and a semiconductor substrate even if the lubricant is scattered.

The present invention provides the following rolling apparatuses.

(1) A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of (1) a thickening agent which is at least one selected from the group consisting of a solid fluoropolymer, a lamellar mineral powder, an ultrafinely particulate organic material, an organic solid lubricant and an ultrafinely particulate inorganic material, and (2) a base oil comprising a liquid fluorinated polymer oil.

(2) The rolling apparatus of item (1), wherein the lubricant composition further contains an oily compound having a perfluoropolyether skeleton as a main chain and a polar group at either or both ends of the main chain and having a molecular weight of not more than 10,000 in an amount of from 0.5 to 10% by weight.

(3) The rolling apparatus of item (1) or (2), wherein the lubricant composition contains the thickening agent in an amount of 0.1 to 45% by weight and the base oil in an amount of 55 to 95% by weight.

(4) The rolling apparatus of item (1) or (2), wherein the lubricant composition contains the lamellar mineral powder having an average particle diameter of 0.05 to 20 μm in an amount of 1 to 45% by weight.

(5) The rolling apparatus of item (1) or (2), wherein the lubricant composition contains the ultrafinely particulate inorganic material having an average particle diameter of 0.1 μm or less in an amount of 0.1 to 20% by weight.

(6) The rolling apparatus of item (1) or (2), wherein the lamellar mineral powder is at least one selected from the group consisting of a mica-based mineral, a vermiculite-based mineral and a montmorillonite-based mineral.

(7) The rolling apparatus of item (1) or (2), wherein the ultrafinely particulate inorganic material is at least one selected from the group consisting of $SiO_2$, MgO, $TrO_2$, $Al_2O_3$, diamond, and fullerence ($C_{60}$).

(8) The rolling apparatus of item (2), wherein the lubricant composition comprises the oily compound consisting of a perfluoropolyether carboxylic acid having a molecular weight of not more than 10,000 in an amount of from 0.5 to 10% by weight.

(9) The rolling apparatus of item (1) or (2), wherein the lubricant composition contains at least one of the ultrafinely particulate organic material and the organic solid lubricant in an amount of 1 to 45% by weight.

(10) The rolling apparatus of item (1) or (2), wherein the ultrafinely particulate organic material has an average particle diameter of 20 nm to 1 $\mu$m.

(11) The rolling apparatus of item (1) or (2), wherein the ultrafinely particulate organic material is an ultrafinely particulate polymer and is at least one selected from the group consisting of a polymer or copolymer of acrylic acid ester, a polymer or copolymer of methacrylic acid ester, a styrene polymer, a styrene-acryl copolymer, and a styrene-methacrylic acid ester copolymer.

(12) The rolling apparatus of item (9), wherein the ultrafinely particulate organic material is spherical and hydrophobic.

(13) The rolling apparatus of item (9), wherein the organic solid lubricant has a white lamellar crystal structure and is at least one selected from the group consisting of an amino acid compound, melamine cyanurate and a carbon fluoride.

(14) The rolling apparatus of item (9), wherein the organic solid lubricant has an average particle diameter of 0.05 to 20 $\mu$m.

BRIEF DESCRIPTION OF THE DRAWINGS

FIG. 5 is a graph illustrating the relationship between the content of ultrafinely particulate inorganic material in the lubricant composition and the torque life in the rolling apparatus according to the examples of the present invention;

FIG. 6 is a graph illustrating the relationship between the content of PFPE carboxylic acid in the lubricant composition and the torque life and dust blowing in the rolling apparatus according to the examples of the present invention;

DETAILED DESCRIPTION OF THE INVENTION

Figure 1:
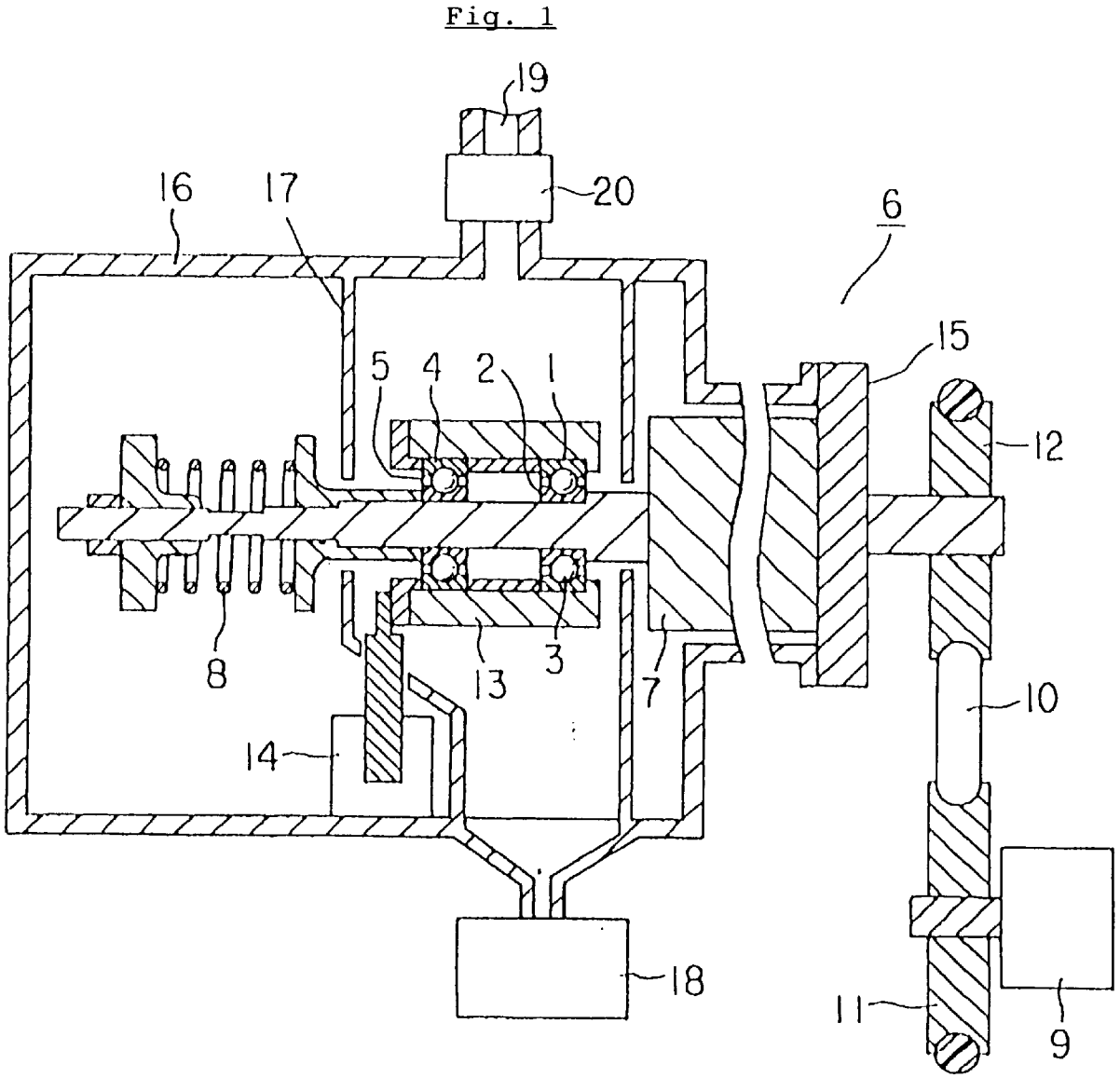
FIG. 1 is a sectional view illustrating the rolling apparatus and bearing rotary testing machine according to the examples of the present invention.

The present invention provides a rolling apparatus comprising a movable member which can undergo rotary or linear motion, a support member carrying said movable member, rolling elements disposed between the movable member and the support member which rolls with the movement of the movable member, and a lubricant composition disposed between the movable member on which the rolling elements roll and the support member, characterized in that the lubricant composition is a mixture of a thickening agent containing a powder of at least one lamellar mineral selected from the group consisting of mica-based mineral, vermiculite-based mineral and montmorillonite-based mineral and a base oil composed of liquid fluorinated polymer oil (First Embodiment).

The present invention also provides a rolling apparatus comprising a movable member which can undergo rotary or linear motion, a support member carrying the movable member, rolling elements disposed between the movable member and the support member which roll with the movement of the movable member, and a lubricant composition disposed between the movable member on which the rolling elements roll and the support member, wherein the lubricating oil composition is a mixture of a thickening agent containing an ultrafinely particulate inorganic material and a base oil composed of liquid fluorinated polymer oil (Second Embodiment).

The present invention further provides a rolling apparatus comprising a movable member which can undergo rotary or linear motion, a support member carrying the movable member, rolling elements disposed between the movable member and the support member which roll with the movement of the movable member, and a lubricant composition disposed between the movable member on which the rolling elements roll and the support member, characterized in that the lubricant composition is either a lubricant composition comprising a perfluoropolyether carboxylic acid having a molecular weight of not more than 10,000 in a base oil composed of liquid fluorinated polymer oil in an amount of from 0.5 to 10% by weight or a grease composition comprising a perfluoropolyether carboxylic acid having a molecular weight of not more than 10,000 in a mixture of a base oil composed of liquid fluorinated polymer oil and a thickening agent containing a solid fluorinated polymer in an amount of from 0.5 to 10% by weight (Third Embodiment).

Preferred embodiments as to the first to third embodiments will be given below.

(1) The lubricant composition contains the thickening agent and the base oil in an amount of from 0.1 to 45% by weight and from 55 to 95% by weight, respectively.

(2) The interface of the thickening agent is subjected to hydrophobic treatment with a surface active agent for hydrophobic treatment.

(3) The lamellar mineral powder contains at least one of lithium ion and sodium ion as an interlaminer ion.

(4) The lubricant composition comprises the lamellar mineral powder in an amount of from 1 to 45% by weight.

(5) The lubricant composition comprises the lamellar mineral powder in an amount of from 3 to 45% by weight.

(6) The average particle diameter of the lamellar mineral powder ranges from 0.05 to 20 $\mu$m.

(7) The ultrafinely particulate inorganic material is at least one particulate material selected from the group consisting of particulate diamond, particulate diamond having a surface layer composed of graphite, particulate fullerence ($C_{60}$), particulate silicon oxide ($SiO_2$), particulate titanium oxide ($TiO_2$), zirconia oxide (ZrO) and particulate magnesium oxide (MgO).

(8) The lubricant composition comprises the ultrafinely particulate inorganic material in an amount of from 0.1 to 40% by weight.

(9) The lubricant composition comprises the ultrafinely particulate inorganic material in an amount of from 0.5 to 30% by weight.

(10) The average particle diameter of the ultrafinely particulate inorganic material is not more than 0.1 $\mu$m.

(11) The lubricant composition comprises an oily compound (with a molecular weight of not more than 10,000) having a perfluoropolyether skeleton as a main chain and a polar group at either or both ends of the main chain in an amount of from 0.5 to 10% by weight.

(12) The lubricant composition comprises a perfluoropolyether carboxylic acid having a molecular weight of not more than 10,000 in an amount of from 0.5 to 10% by weight.

The present invention provides a rolling apparatus comprising a movable member which can undergo rotary or linear motion, a support member carrying the movable member, a rolling elements disposed between the movable member and the support member which roll with the movement of the movable member, and a lubricant composition disposed between the movable member on which the rolling elements roll and the support member, characterized in that the lubricant composition comprises a mixture of a thickening agent containing an ultrafinely particulate organic material and a base oil composed of liquid fluorinated polymer oil (Fourth Embodiment).

Preferred embodiments of the fourth embodiment will be given below.

(1) The ultrafinely particulate organic material is composed of a polymer having a three-dimensional network;

(2) The ultrafinely particulate organic material is flexible;

(3) The ultrafinely particulate organic material swells in the base oil;

(4) The ultrafinely particulate organic material is white;

(5) All the elements constituting the ultrafinely particulate organic material are non-metallic elements;

(6) The ultrafinely particulate organic material is spherical;

(7) The lubricant composition contains an oil-like compound (with a molecular weight of not more than 10,000) having a perfluoropolyether skeleton as a main chain and a polar group at either or both ends of the main chain in an amount of from 0.5 to 10% by weight.

(8) The lubricant composition comprises the thickening agent and base oil incorporated therein in an amount of from 0.1 to 45% by weight and from 55 to 95% by weight, respectively;

(9) The ultrafinely particulate organic material is hydrophobic;

(10) The lubricant composition comprises the ultrafinely particulate organic material incorporated therein in an amount of from 1 to 45% by weight;

(11) The lubricant composition comprises the ultrafinely particulate organic material incorporated therein in an amount of from 3 to 45% by weight; and

(12) The ultrafinely particulate organic material has an average particle diameter of from 20 nm to 1 $\mu$m.

The present invention provides a rolling apparatus comprising a movable member which can undergo rotary or linear motion, a support member carrying the movable member, a rolling elements disposed between the movable member and the support member which roll with the movement of the movable member, and a lubricant composition disposed between the movable member on which the rolling elements roll and the support member, characterized in that the lubricant composition comprises a mixture of a thickening agent containing a white powder substantially consisting of non-metallic elements and a base oil composed of liquid fluorinated polymer oil (Fifth Embodiment).

Preferred embodiments of the fifth embodiment will be given below:

(1) The white powder is composed of a compound having a lamellar crystal structure;

(2) The white powder has cleavability;

(3) The white powder is composed of a compound selected from the group consisting of amino acid compound, melamine cyanurate and carbon fluoride;

(4) The lubricant composition contains an oil-like compound with a molecular weight of not more than 10,000 having a perfluoropolyether skeleton as a main chain and a polar group at either or both ends of the main chain in an amount of from 0.5 to 10% by weight.

(5) The lubricant composition contains the thickening agent and base oil incorporated therein in an amount of from 0.1 to 45% by weight and from 55 to 95% by weight, respectively;

(6) The lubricant composition contains the white powder incorporated therein in an amount of from 1 to 45% by weight;

(7) The lubricant composition contains the white powder incorporated therein in an amount of from 3 to 45% by weight; and (8) The white powder has an average particle diameter of from 0.05 $\mu$m to 20 $\mu$m.

The present invention will be further described hereinafter.

The rolling apparatus according to the first to fifth embodiments of the present invention is used as a rolling bearing, direct-acting apparatus or the like. The term "direct-acting apparatus" as used herein is meant to indicate a direct-acting driving apparatus such as ball screw apparatus or direct-acting guide such as linear guide. Any of these rolling bearing and direct-acting apparatuses comprises a movable member carried on a support member with rolling elements provided interposed therebetween and a lubricant composition disposed between the support member and the movable member. Rolling apparatuses according to the first to fifth embodiments of the present invention will be described hereinafter with reference to the case where they are applied to a rolling bearing, a direct-acting driving apparatus and a direct-acting guide apparatus.

If a rolling apparatus according to any one of the first to fifth embodiments of the present invention is used as a rolling bearing, a cylindrical outer race and an inner race having a smaller outer diameter than the outer race are used as a support member and a movable member, respectively. In this rolling bearing, the inner race and the outer race are disposed coaxially, and groove-like tracks are provided on the outer circumference of the inner race and the inner circumference of the outer race. Rolling elements are disposed between the inner race and the outer race in such an arrangement that they roll on the track on the inner race and the outer race. Further, a lubricant composition for protecting the rolling elements, etc. against abrasion or other troubles is provided therebetween.

In this rolling bearing, the inner race undergoes rotary motion relative to the outer race when acted upon by external force but does not move axially. Accordingly, the rolling elements may be in the form of spherical ball or roller such as column and cone.

If the rolling apparatus according to any one of the first to fifth embodiments of the present invention is used as a direct-acting apparatus, a screw axis having a thread groove provided on the side wall thereof is used as a support member. As a movable member there is used a nut having a thread groove provided on the surface thereof opposed to the screw axis. The rolling elements are rotatably disposed between the thread grooves on the screw axis and the nut.

In this arrangement, by rotating the screw axis while inhibiting the rotation of the nut, the rolling elements move in the axial direction of the screw axis, making it possible to move the nut in the axial direction of the screw axis. In the direct-acting apparatus, the rolling elements are spherical, and the nut is structured such that the rolling elements are circulated in the thread groove.

The rolling apparatus according to any one of the first to fifth embodiments of the present invention will be described hereinafter with reference to the case where it is used as a direct-acting guide. In the direct-acting guide, a guide axis having no thread grooves provided on the side wall thereof is used as a support member, and a slider which can move in the axial direction of the guide axis is used as a movable member. In the direct-acting guide, the slider is disposed so as to move in the axial direction of the guide axis when acted upon by external force, and the rolling elements are disposed rotatably between the slider and the guide axis. The rolling elements may be disposed embedded in the slider or guide axis.

The rolling apparatus as mentioned above has the same arrangement as ordinary rolling apparatuses except that the lubricant composition used is different. Accordingly, as the materials of the support member, rolling elements and movable member there may be used commonly used materials. These materials are not specifically limited. Examples of these materials include metal steel such as bearing steel and stainless steel, and ceramics such as silicon nitride ($Si_3N_4$), silicon carbide (SiC), Sialone, partially-stabilized zirconia ($ZrO_2$) and alumina ($Al_2O_3$). These materials may be used singly or in combination.

The lubricant composition to be used in the rolling apparatuses according to the first to fifth embodiments of the present invention will be described hereinafter. The lubricant composition to be used in the rolling apparatus according to the present invention is disposed between the movable member and the support member to prevent abrasion and reduce contact resistance on the rolling contact surface of the rolling elements or the sliding contact surface of the movable member with the support member. The lubricant compositions to be used in the first to fifth embodiments of the present invention will be sequentially described hereinafter.

First Embodiment

The lubricant composition to be used in the rolling apparatus according to the first embodiment of the present invention comprises a thickening agent containing a lamellar mineral powder and a base oil composed of liquid fluorinated polymer oil. As the lamellar mineral powder to be incorporated in the thickening agent there may be used a powder of mica-based mineral, vermiculite-based mineral or montmorillonite-based mineral having a lamellar crystal structure as graphite or hexagonal boron nitride.

The physical properties common to the lamellar minerals will be described hereinafter with reference to mica. Mica is mainly composed of $SiO_2$, which accounts for from 40 to 50% of all the components. In the mica crystal, Si is oriented as ligand in oxygen tetrahedron. This Si—$O_4$ bond is very strong. The mica crystal has a lamellar structure formed by laminating a plurality of sandwich layers called tablet consisting of a pair of layers composed of the tetrahedron and ions oriented in the form of octahedron such as $Al^{3+}$, $Fe^{2+}$ and $Mg^{2+}$ disposed between the pair of layers. Provided interposed between these tablets are alkaline metal or alkaline earth metal ions called interlaminer ion. These interlaminer ions and oxygen atoms are ionically bonded to each other. However, the ionic bond of the interlaminer ions to oxygen atoms is very weak. This is why mica is liable to peeling at planes formed by interlaminer ions.

Thus, the lamellar mineral to be used in the rolling apparatus according to the first embodiment of the present invention has a weak intertablet bond. Thus, when acted upon by shearing force, the lamellar mineral is liable to cleavage at planes formed by interlaminer ions. Accordingly, the use of the lamellar mineral as a lubricant composition makes it possible to reduce the coefficient of abrasion on the rolling contact surface and sliding contact surface of the rolling elements, movable member and support member. In other words, abrasion on the contact surface, torque increase or seizing can be inhibited.

As mentioned above, the rolling apparatus according to the first embodiment of the present invention comprises the lubricant composition and thus can be kept fairly lubricated over an extended period of time. In other words, the first embodiment of the present invention provides a rolling apparatus which shows minimized dust blowing and prolonged torque life.

As mentioned above, the thickening agent to be incorporated in the lubricant composition comprises a powder of at least one lamellar mineral selected from the group consisting of mica-based mineral, vermiculite-based mineral and montmorillonite-based mineral. The chemical composition of the mica-based mineral is represented by the general formula $XMg_2Li(Y_4O_{10})Z_2$ or $XMg_{2.5}(Y_4O_{10})Z_2$. The chemical composition of the vermiculite-based mineral is represented by the general formula $X_{2/3}Mg_{7/3}Li_{2/3}(Y_4O_{10})Z_2$. The chemical composition of the montmorillonite-based mineral is represented by the general formula $X_{1/3}Mg_{8/3}Li_{1/3}(Y_4O_{10})Z_2$. In the general formulae, X represents K, Na or Li, Y represents Si or Ge, and Z represents F or OH.

The lamellar mineral preferably contains at least one of lithium ion and sodium ion as an interlaminer ion. When incorporated in various solvents such as water and oil, mica-based mineral, vermiculite-based mineral and montmorillonite-based mineral, which contain such an interlaminer ion having a small ion radius, take the solvent into the crystal layers to expand, i.e., swell.

If a lubricant composition is prepared by mixing such a swelling lamellar mineral powder with a base oil, the base oil is partially taken into the lamellar mineral powder. Accordingly, the use of such a lubricant composition makes it possible to replenish the contact surface with the oil base if it lacks the base oil. Further, if the base oil is excessively present on the contact surface, the base oil can be taken into the lamellar mineral powder. This makes it possible to invariably replenish the contact surface with an appropriate amount of the base oil. As a result, a longer torque life can be provided and the scattering of the base oil during the operation of the rolling apparatus can be effectively inhibited.

Further, the lamellar mineral powder is preferably subjected to hydrophobic treatment on the interface thereof with a surface active agent for hydrophobic treatment before use. The hydrophobic treatment of the interface of the powder makes it possible to prevent the powder from taking water thereinto and allow the powder to take the base thereinto selectively and efficiently. Accordingly, the rolling apparatus can be kept fairly lubricated over an extended period of time, exhibits a prolonged torque life and shows reduced dust blowing.

The surface active agent to be used in the hydrophobic treatment is not specifically limited so far as it contains an alkyl group having 8 or more carbon atoms. In practice, however, ammonium salt compounds or alkylamine-based surface active agents containing a functional group such as —$NH_2$ group, —OH group and —COOH group may be used.

The lamellar mineral powder as mentioned above is preferably incorporated in the lubricant composition in an amount of from 0.1 to 45% by weight, more preferably from 1 to 45% by weight, most preferably from 3 to 45% by weight. If the content of the lamellar mineral powder falls below the above defined lower limit, the desired effect of improving lubricity and inhibiting the leakage or scattering of the lubricant may not be exerted. On the contrary, if the content of the lamellar mineral powder exceeds the above defined upper limit, the mixing proportion of the base oil is reduced, excessively increasing the viscosity of the lubricant composition. Thus, a sufficient lubricity cannot be obtained. As a result, abrasion may occur to increase torque in a relatively short period of time.

The average particle diameter of the lamellar mineral powder is preferably from 0.05 to 20 $\mu$m, more preferably from 0.1 to 10 $\mu$m. If the average particle diameter of the lamellar mineral powder falls below the above defined lower limit, agglomeration of powder particles occurs to produce a secondary particle that can deteriorate dispersibility when mixed with the base oil and other components to prepare a lubricant composition. On the contrary, if the average particle diameter of the lamellar mineral powder exceeds the above defined upper limit, the powder can sparingly enter into the rolling contact surface or sliding contact surface or can be caught by these surfaces to drastically increase the torque of the rolling apparatus, possibly disabling the rolling apparatus.

The thickening agent to be used in the rolling apparatus according to the first embodiment of the present invention may comprise a solid fluorinated polymer incorporated therein besides the lamellar mineral powder. Examples of such a solid fluorinated polymer include polytetrafluoroethylene (hereinafter referred to as "PTFE"), copolymer of tetrafluoroethylene with hexafluoropropene, copolymer of tetrafluoroethylene with perfluoropropyl polyvinyl ether, and mixture thereof.

The thickening agent as mentioned above is preferably incorporated in the lubricant composition in an amount of from 5 to 45% by weight, more preferably from 15 to 40% by weight. If the content of the thickening agent falls below the above defined lower limit, the desired effect of improving lubricity and inhibiting the leakage or scattering of the lubricant may not be exerted. On the contrary, if the content of the thickening agent exceeds the above defined upper limit, the mixing proportion of the base oil is reduced, excessively increasing the viscosity of the lubricant composition. Thus, a sufficient lubricity cannot be obtained. As a result, abrasion may occur to increase torque in a relatively short period of time.

The base oil to be used in the rolling apparatus according to the first embodiment of the present invention is not specifically limited so far as it is a liquid fluorinated polymer oil. In practice, however, perfluoropolyether (hereinafter referred to as "PFPE"), trifluoroethylene telomer, fluorosilicone polymer, etc. may be used. This base oil is preferably incorporated in the lubricant composition in an amount of from 55 to 95% by weight. If the content of the base oil falls below the above defined lower limit, the torque increase may occur in a short period of time. On the contrary, if the content of the base oil exceeds the above defined upper limit, the desired effect of inhibiting the leakage or scattering of the lubricant may not be exerted.

Second Embodiment

The lubricant composition to be used in the rolling apparatus according to the second embodiment of the present invention will be described hereinafter.

The lubricant composition to be used in the rolling apparatus according to the second embodiment of the present invention comprises a thickening agent containing an ultrafinely particulate inorganic material and a base oil composed of liquid fluorinate polymer oil. The rolling apparatus according to the second embodiment of the present invention may use the same liquid fluorinated polymer oil as mentioned with reference to the first embodiment of the present invention as a base oil.

The ultrafinely particulate material to be incorporated in the thickening agent in the rolling apparatus according to the second embodiment of the present invention has a small particle diameter and a round surface. The use of such a lubricant composition containing an ultrafinely particulate material produces a so-called microbearing effect, i.e., of allowing the ultrafinely particulate material to roll on the rolling contact surface and sliding contact surface of the rolling elements, movable member and support member. Accordingly, the coefficient of friction on these contact surfaces can be reduced. Further, even when the rolling apparatus operates under a great load, at a low speed or with the base oil running short at the gap between these contact surfaces, the direct contact or cohesion of the rolling contact surfaces or sliding contact surfaces with each other can be prevented. Accordingly, the rolling apparatus according to the second embodiment of the present invention can be protected against abrasion or seizing at these contact surfaces and thus can be kept fairly lubricated over an extended period of time.

Examples of the ultrafinely particulate inorganic material to be used in the rolling apparatus according to the second embodiment of the present invention include particulate inorganic compounds such as particulate $SiO_2$, particulate MgO, particulate $TrO_2$ and particulate $Al_2O_3$, and particulate inorganic materials composed of carbon atoms only such as particulate diamond and particulate fullerence ($C_{60}$). Such a particulate inorganic material can be formed having a small particle diameter and a round shape. Preferred among these ultrafinely particulate inorganic materials are particulate diamond and particulate fullerence ($C_{60}$).

Particulate diamond is extremely chemically unstable and very hard and thus is not liable to destruction. If the ultrafinely particulate inorganic material is destroyed, it can have a shape with sharp corners or form sharp sections. On the contrary, if particulate diamond is used as an ultrafinely particulate inorganic material, it is little liable to these troubles. Accordingly, the rolling apparatus can be kept fairly lubricated over an extended period of time.

Further, in this case, particulate diamond is preferably chemically coated with graphite on the surface thereof before use. The coating of the surface of particulate diamond with graphite makes it possible to improve the lubricity of the interface of the ultrafinely particulate inorganic material. Thus, the rolling apparatus can be kept fairly lubricated over an extended period of time.

The use of particulate fullerence ($C_{60}$), too, keeps the rolling apparatus fairly lubricated over an extended period of time. The reason is as follows. Fullerence ($C_{60}$) is a soccer ball-like molecule containing 60 carbon atoms and a closed structure composed of a series of a plurality of 5-membered and 6-membered rings. Fullerence ($C_{60}$) is extremely thermally stable and is known to resist destruction up to 1,500° C. Further, because of its spherical molecular structure, fullerence ($C_{60}$) can exert the microbearing effect more remarkably. Moreover, fullerence ($C_{60}$) has lubricity itself. Accordingly, the use of fullerence ($C_{60}$) as an ultrafinely particulate inorganic material makes it possible to keep the rolling apparatus fairly lubricated over a longer period of time.

The ultrafinely particulate inorganic material is preferably incorporated in the lubricant composition in an amount of from 0.1 to 40% by weight, more preferably from 0.5 to 30% by weight based on the lubricant composition. If the content of the ultrafinely particulate inorganic material falls below the above defined lower limit, the desired effect of improving lubricity and inhibiting the leakage or scattering of the lubricant may not be exerted. On the contrary, if the content of the ultrafinely particulate inorganic material exceeds the above defined upper limit, the mixing proportion of the base oil is reduced, excessively increasing the viscosity of the lubricant composition. Thus, a sufficient lubricity cannot be obtained. Further, the ultrafinely particulate inorganic material can cause abrasion. Thus, the rise in surface roughness or abnormal abrasion occurs in a relatively short period of time. As a result, torque or vibration rise or seizing can occur.

The average particle diameter of the ultrafinely particulate inorganic material is preferably not more than 0.1 $\mu$m. If the average particle diameter of the ultrafinely particulate inorganic material falls below the above defined upper limit, the powder slightly enter into the rolling contact surface or sliding contact surface or can be caught by these surfaces. Further, the ultrafinely particulate inorganic material causes abrasion. Thus, the rise in surface roughness or abnormal abrasion can occur in a relatively short period of time. Accordingly, the torque of the rolling apparatus is drastically raised, possibly disabling the rolling apparatus.

The lamellar mineral powder described with reference to the first embodiment of the present invention is in the form of scale. The thickness of the lamellar mineral powder is smaller than the average particle diameter thereof. Further, since the lamellar mineral powder is liable to cleavage and soft, it can enter into the gap between the contact surfaces and cannot damage these contact surfaces even if it has an average particle diameter of from 0.1 to 10 $\mu$m. However, since the ultrafinely particulate inorganic material is spherical, it can sparingly enter into the gap between these contact surfaces if it has an average particle diameter of more than 0.1 $\mu$m (more than the thickness of an oil film present interposed between these contact surfaces). Further, since the ultrafinely particulate inorganic material is hard, it can cause abrasion on these contact surfaces if it has an average particle diameter of more than 0.1 $\mu$m. Accordingly, the lamellar mineral powder and the ultrafinely particulate inorganic material differ from each other in preferred particle diameter range.

The thickening agent to be used in the rolling apparatus according to the second embodiment of the present invention may comprise the same solid fluorinated polymer as described with reference to the first embodiment of the present invention incorporated therein besides the ultrafinely particulate inorganic material.

In the rolling apparatus according to the second embodiment of the present invention, the thickening agent is preferably incorporated in the lubricant composition in an amount of from 5 to 45% by weight, more preferably from 15 to 40% by weight. If the content of the thickening agent falls below the above defined lower limit, the desired effect of improving lubricity and inhibiting the leakage or scattering of the lubricant may not be exerted. On the contrary, if the content of the thickening agent exceeds the above defined upper limit, the mixing proportion of the base oil is reduced, excessively increasing the viscosity of the lubricant composition. Thus, a sufficient lubricity cannot be obtained. As a result, abnormal abrasion may occur to increase torque in a relatively short period of time.

Third Embodiment

The lubricant composition to be used in the rolling apparatus according to the third embodiment of the present invention will be described hereinafter.

The lubricant composition to be used in the rolling apparatus according to the third embodiment of the present invention comprises a base oil composed of liquid fluorinated polymer oil and from 0.5 to 10% by weight of an oily compound. The oily compound is an organic compound having a molecular weight of not more than 10,000 and having a perfluoropolyether skeleton as a main chain and a polar group at at least one end of the main chain. As the base oil to be incorporated in the rolling apparatus according to the third embodiment of the present invention there may be used the same liquid fluorinated polymer oil as described with reference to the first embodiment of the present invention.

The oily compound has a skeleton similar to that of the liquid fluorinated polymer oil used as a base oil and thus can be easily dissolved in the base oil and cannot be separated from the base oil. Further, since the vapor pressure of the oily compound is low, the evaporation loss in vacuo is extremely small.

Further, the oily compound contains a substituent having a high polarity at the end of the main chain and thus can be easily adsorbed to the surface of the metal. In other words, since the oily compound is physically or chemically adsorbed to the rolling contact surface and sliding contact surface of the rolling elements, movable member and support member, direct contact of these contact surfaces with each other can be prevented even if these contact surfaces lack the base oil. Accordingly, the rolling apparatus according to the third embodiment of the present invention exhibits a reduced coefficient of friction on these contact surfaces and thus can be protected against abrasion or seizing of contact surfaces and torque rise.

The oily compound has a molecular weight of not more than 10,000. If the molecular weight of the oily compound exceeds the above defined upper limit, its adsorptivity to the rolling contact surface or sliding contact surface is reduced, possibly making it impossible to exert an effect of improving lubricity.

Further, the oily compound is preferably incorporated in the lubricant composition in an amount of from 0.5 to 10% by weight based on the lubricant composition. If the content of the oily compound falls below the above defined lower limit, the desired effect of improving lubricity and inhibiting the leakage or scattering of the lubricant may not be exerted. On the contrary, if the content of the oily compound exceeds the above defined upper limit, the resulting lubricant composition exhibits a reduced viscosity that can make the lubricant composition liable to scattering or leakage.

The lubricant composition to be used in the rolling apparatus according to the third embodiment of the present invention may comprise a thickening agent incorporated therein. As the thickening agent to be incorporated in the lubricant composition there may be used the same solid fluorinated polymer as described with reference to the first embodiment of the present invention. As the thickening agent there may also be used the solid fluorinated polymer which contains a lamellar mineral powder or ultrafinely particulate inorganic material as described with reference to the first and second embodiments of the present invention incorporated therein. The lamellar mineral powder or ultrafinely particulate inorganic material can be incorporated in the solid fluorinated polymer in the same content as described with reference to the first and second embodiments of the present invention.

In the case where the lubricant composition is one comprising a base oil composed of liquid fluorinated polymer oil and the oily compound or one comprising a base oil composed of liquid fluorinated polymer oil, a thickening agent composed of solid fluorinated polymer, and the oily compound, as the oily compound there may be used a perfluoropolyether carboxylic acid having a molecular weight of not more than 10,000 represented by the following general formula (1).

$$F(CF_2CF_2CF_2O)_nC_2F_4COOH \quad (1)$$

wherein n represents a positive integer.

If the oily compound is incorporated in the lubricant composition described with reference to the first and second embodiments of the present invention, as the oily compound there may be used any one of compounds represented by the following general formulae besides the compound of the general formula (1).

$$RCF_2(\underset{\underset{CF_3}{|}}{OCFCF_2})_n(OCF_2)_mOCF_2R \quad (2)$$

$$R(\underset{\underset{CF_3}{|}}{CFCF_2O})_nCF_2CF_2R \quad (3)$$

$$RCF_2[(OCF_2CF_2)(OCF_2)]OCF_2R \quad (4)$$

$$R(CF_2CF_2CF_2O)_nCF_2CF_2R \quad (5)$$

wherein m and n each represent a positive integer.

In the compounds represented by the general formulae (2) to (5), at least one of substituents R is a polar group such as carboxyl group (—COOH), alcohol group and isocyanate group. Examples of the alcohol group and isocyanate group include substituents represented by the following general formulae (6) to (9):

$$—CH_2OH \quad (6)$$

$$—CF_2CH_2OCH_2\underset{\underset{OH}{|}}{CH}CH_2OH \quad (7)$$

$$—CF_2CH_2(OCH_2CH_2)_nOH \quad (8)$$

$$—CONHC_6H_3(CH_3)NCO \quad (9)$$

In the general formulae (2) to (5), if the two substituents R each are a polar group such as carboxyl group, alcohol group and isocyanate group at the same time, they may be the same or different. Alternatively, if only one of the two substituents R is a polar group such as carboxyl group, alcohol group and isocyanate group, the other substituent R is preferably a fluorine atom.

Fourth Embodiment

The lubricant composition to be used in the rolling apparatus according to the fourth embodiment of the present invention will be described hereinafter.

The lubricant composition to be used in the rolling apparatus according to the fourth embodiment of the present invention comprises as essential components a thickening agent containing an ultrafinely particulate organic material and a base oil composed of a liquid fluorinated polymer oil incorporated therein.

The ultrafinely particulate organic material to be incorporated in the thickening agent is not specifically limited. In practice, however, an ultrafinely particulate polymer produced by an ordinary technique such as emulsion polymerization, multi-stage emulsion polymerization, suspension polymerization and NAD (non-aqueous dispersion) may be used. Examples of the ultrafinely particulate organic material employable herein include polymer or copolymer of acrylic acid ester represented by the general formula $CH_2{=}CHCOOR$ such as methyl acrylate, ethyl acrylate, 2-ethylhexyl acrylate and n-butyl acrylate, polymer or copolymer of methacrylic acid ester represented by the general formula $CH_2{=}C(CH_3)COOR$ such as ethyl methacrylate, glycidyl methacrylate, cyclohexyl methacrylate, hydroxyethyl methacrylate, n-butyl methacrylate, hexyl methacrylate and methyl methacrylate, styrene polymer, styrene-acryl copolymer, and styrene-methacrylic acid ester copolymer.

The lubricant composition to be used in the rolling apparatus according to the fourth embodiment of the present invention is prepared by mixing the ultrafinely particulate organic material and base oil. The lubricant composition thus prepared is disposed between the movable member and the support member. Accordingly, in accordance with the rolling apparatus according to the fourth embodiment of the present invention, the ultrafinely particulate organic material is disposed between the rolling contact surfaces or sliding contact surfaces of the movable member, support member and rolling elements so that these members can be prevented from coming in direct contact with each other even if the lubricant composition or grease runs short.

The ultrafinely particulate organic material is an intermolecularly crosslinked high molecular compound having an internally three-dimensional network, i.e., so-called microgel. It is very soft as compared with the materials constituting the movable member, support member and rolling elements. Accordingly, the ultrafinely particulate organic material cannot damage these members. In other words, the ultrafinely particulate organic material does not accelerate abrasion.

Further, because of its crosslinked structure, the ultrafinely particulate organic material, when mixed with various solvents, takes the solvent into its crosslinked structure to swell rather than being dissolved in the solvent. In the rolling apparatus according to the fourth embodiment of the present invention, the base oil is used in admixture with the ultrafinely particulate organic material having swelling properties. Therefore, the base oil is partially taken into the ultrafinely particulate organic material. Accordingly, the contact surfaces can be replenished with the base oil whenever they lack of base oil. Moreover, if the base oil is excessively present on the contact surfaces, it can be taken into the ultrafinely particulate organic material. Accordingly, a proper amount of the base oil can be always supplied into the contact surfaces, making it possible to effectively prevent the base oil from being scattered during the operation of the rolling apparatus.

The ultrafinely particulate organic material is normally shaped in spherical form. The use of such an ultrafinely particulate material shaped in spherical form produces a so-called microbearing effect, i.e., of allowing the ultrafinely particulate material to roll on the surfaces of the members. Accordingly, the coefficient of friction on these rolling and sliding contact surfaces can be reduced. Thus, torque fluctuations or seizing can be more effectively prevented, making it possible to keep the rolling apparatus fairly lubricated over a longer period of time.

The ultrafinely particulate organic material is preferably hydrophobic. The use of such a hydrophobic ultrafinely particulate organic material makes it possible to prevent itself from taking water thereinto and allow itself to take the base thereinto selectively and efficiently. Accordingly, the rolling apparatus can be kept fairly lubricated over an extended period of time, exhibits a prolonged torque life and shows reduced dust blowing.

In the rolling apparatus according to the fourth embodiment of the present invention, the surface of the ultrafinely particulate organic material may be modified with a functional group such as $-NH_2$ group, —OH group and —COOH group, a polymerizable C=C group or the like. Alternatively, the surface of the ultrafinely particulate organic material may be modified with a polymer chain formed by polymerizable C=C group onto which polymer chain some groups may be grafted. The surface treatment of the ultrafinely particulate organic material stabilizes the dispersibility in the base oil or the like and improves the adsorptivity to the surface of the members, making it possible to keep the rolling apparatus fairly lubricated over a longer period of time.

Further, the ultrafinely particulate organic material is preferably white. Such a white ultrafinely particulate organic material never blackens the object to be treated such as liquid crystal panel and semiconductor substrate even if the lubricant composition is scattered.

As mentioned above, the fourth embodiment of the present invention is based on the knowledge that the use of a mixture of a thickening agent containing an ultrafinely particulate organic material and a base oil composed of a liquid fluorinated polymer oil as a lubricant composition for rolling apparatus makes it possible to drastically improve lubricity and durability and minimize dust blowing.

The ultrafinely particulate organic material is preferably incorporated in the lubricant composition in an amount of from 0.1 to 45% by weight, more preferably from 1 to 45% by weight, even more preferably from 3.5 to 45% by weight, most preferably from 15 to 45% by weight based on the lubricant composition. If the content of the ultrafinely particulate organic material falls below the above defined lower limit, the desired effect of improving lubricity and inhibiting the leakage or scattering of the lubricant may not be exerted. On the contrary, if the content of the ultrafinely particulate organic material exceeds the above defined upper limit, the base oil runs short, making it impossible to provide a sufficient lubricity. Thus, abnormal abrasion can occur in a relative short period of time. As a result, torque can be raised. In this case, the viscosity of the lubricant composition is excessively raised, possibly raising the torque even if no abnormal abrasion occurs.

The average particle diameter of the ultrafinely particulate organic material is preferably from 20 nm to 1 $\mu$m. If the average particle diameter of the ultrafinely particulate organic material falls below the above defined lower limit, agglomeration of powder particles occurs to produce a secondary particle that causes deteriorated dispersibility when mixed with the base oil and other components to prepare a lubricant composition. On the contrary, if the average particle diameter of the ultrafinely particulate organic material exceeds the above defined upper limit, the powder sparingly enter into the rolling contact surface or sliding contact surface or can be caught by these surfaces to drastically increase the torque of the rolling apparatus, possibly disabling the rolling apparatus.

The thickening agent to be used in the rolling apparatus according to the fourth embodiment of the present invention may comprise a solid fluorinated polymer incorporated therein besides the ultrafinely particulate organic material. Examples of such a solid fluorinated polymer include polytetrafluoroethylene (hereinafter referred to as "PTFE"), copolymer of tetrafluoroethylene with hexafluoropropene, copolymer of tetrafluoroethylene with perfluoropropyl polyvinyl ether, and mixture thereof.

The thickening agent as mentioned above is preferably incorporated in the lubricant composition in an amount of from 5 to 45% by weight, more preferably from 15 to 40% by weight. If the content of the thickening agent falls below the above defined lower limit, the desired effect of improving lubricity and inhibiting the leakage or scattering of the lubricant may not be exerted. On the contrary, if the content of the thickening agent exceeds the above defined upper limit, the base oil runs short, making it impossible to provide a sufficient lubricity. Thus, abnormal abrasion can occur in a relative short period of time. As a result, torque can be raised. In this case, the viscosity of the lubricant composition is excessively raised, possibly raising the torque even if no abnormal abrasion occurs.

The base oil to be used in the rolling apparatus according to the fourth embodiment of the present invention is the same as those described with respect to the first embodiment, and is not specifically limited so far as it is a liquid fluorinated polymer oil. For example, perfluoropolyether (PFPE), trifluoroethylene telomer, fluorosilicone polymer, etc. can be used.

Fifth Embodiment

The lubricant composition to be used in the rolling apparatus according to the fifth embodiment of the present invention will be described hereinafter.

The lubricant composition to be used in the rolling apparatus according to the fifth embodiment of the present invention comprises a thickening agent containing a white powder composed of a non-metallic element and a base oil composed of liquid fluorinate polymer oil as essential components. The rolling apparatus according to the fifth embodiment of the present invention may use the same liquid fluorinated polymer oil as mentioned with reference to the fourth embodiment of the present invention as a base oil.

The lubricant composition comprising such a white ultrafinely particulate organic material cannot blacken the object to be treated such as liquid crystal panel and semiconductor substrate even if the lubricant composition is scattered. Further, the white powder is free of metallic elements. Therefore, even if attached to the object to be treated such as semiconductor substrate, the white powder causes no troubles such as defect and electric shortcircuiting.

Further, even if the rolling and sliding contact surfaces of the rolling elements, movable member and support member lack the base oil, they can be prevented from coming in direct contact with each other because the white powder is present interposed therebetween. In other words, abrasion or seizing of the contact surfaces can be prevented, making it possible to keep the rolling apparatus fairly lubricated over an extended period of time.

As the material to be used as the white powder contained in the thickening agent there may be used amino acid compound having a lamellar crystal structure, melamine cyanurate (MCA), and carbon fluoride.

As the amino acid compound having a lamellar crystal structure there may be used, e.g., N-lauroyl.L-lysine represented by the following chemical formula (1):

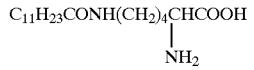

$$C_{11}H_{23}CONH(CH_2)_4\underset{\underset{NH_2}{|}}{C}HCOOH \quad (1)$$

N-lauroyl.L-lysine represented by the chemical formula (1) has a lamellar structure as graphite and thus can easily undergo cleavage.

Melamine cyanurate (MCA) is composed of melamine molecule and cyanuric acid molecule. The melamine molecule and the cyanuric acid molecule are strongly bonded to each other via hydrogen bond to form a planar layer. The powder of melamine cyanurate has a lamellar structure formed by laminating these planar layers by a weak bonding strength such as van der Waals force. In other words, the powder of melamine cyanurate has a lamellar structure as graphite and thus can easily undergo cleavage.

Carbon fluoride is a compound represented by the general formula $(CF)_n$ or $(CF_2)_n$ and can be easily obtained by fluorinating a carbon source with a fluorinating agent such as fluorine gas. The carbon source to be used herein is not specifically limited. In practice, however, crystalline graphite, amorphous carbon, etc. may be used. Further, the carbon fluoride may be in incompletely fluorinated form. In other words, the carbon fluoride may have unreacted carbons left therein.

All the amino acid compound having a lamellar crystal structure, melamine cyanurate (MCA) and carbon fluoride have a lamellar structure which can be easily cleaved as graphite. Accordingly, such a compound, if used as the white powder to be present between the rolling and sliding contact surfaces of the rolling elements, movable member and support member, undergoes cleavage to reduce the coefficient of friction whenever these contact surfaces lack the base oil. In other words, the use of a white powder composed of such a compound makes it possible to reduce abrasion on these contact surfaces and prevent torque rise or seizing.

The white powder is preferably incorporated in the lubricant composition in an amount of from 0.1 to 45% by weight, more preferably from 1 to 45% by weight, most preferably from 3 to 45% by weight based on the lubricant composition. If the content of the white powder falls below the above defined lower limit, the desired effect of improving lubricity and inhibiting the leakage or scattering of the lubricant may not be exerted. On the contrary, if the content of the white powder exceeds the above defined upper limit, the base oil runs short, making it impossible to provide a sufficient lubricity. Thus, abnormal abrasion can occur in a relative short period of time. As a result, torque can be raised. In this case, the viscosity of the lubricant composition is excessively raised, possibly raising the torque even if no abnormal abrasion occurs.

The average particle diameter of the ultrafinely particulate organic material is preferably from 0.05 $\mu$m to 20 $\mu$m. If the average particle diameter of the ultrafinely particulate organic material falls below the above defined lower limit, agglomeration of powder particles occurs to produce a secondary particle that can deteriorate dispersibility when mixed with the base oil and other components to prepare a lubricant composition. On the contrary, if the average particle diameter of the ultrafinely particulate organic material exceeds the above defined upper limit, the powder sparingly enter into the rolling contact surface or sliding contact surface or can be caught by these surfaces to drastically increase the torque of the rolling apparatus, possibly disabling the rolling apparatus.

The thickening agent to be used in the rolling apparatus according to the fifth embodiment of the present invention may comprise the same solid fluorinated polymer as described with reference to the fourth embodiment of the present invention incorporated therein besides the ultrafinely particulate inorganic material. The thickening agent may comprise the same ultrafinely particulate organic material as described with reference to the fourth embodiment incorporated therein.

The thickening agent as mentioned above is preferably incorporated in the lubricant composition in an amount of from 5 to 45% by weight, more preferably from 15 to 40% by weight. If the content of the thickening agent falls below the above defined lower limit, the desired effect of improving lubricity and inhibiting the leakage or scattering of the lubricant may not be exerted. On the contrary, if the content of the thickening agent exceeds the above defined upper limit, the base oil runs short, making it impossible to provide a sufficient lubricity. Thus, abnormal abrasion can occur in a relative short period of time. As a result, torque can be raised. In this case, the viscosity of the lubricant composition is excessively raised, possibly raising the torque even if no abnormal abrasion occurs.

The lubricant composition to be used in the rolling apparatus according to the fourth and fifth embodiments of the present invention comprises from 0.5 to 10% by weight of the oily compound described above with respect to the first to third embodiments. The oily compound is an organic compound with a molecular weight of not more than 10,000 having a perfluoropolyether skeleton as a main chain and a polar group at at least one end of the main chain.

The oily compound has a skeleton similar to that of the liquid fluorinated polymer oil used as a base oil and thus can be easily dissolved in the base oil and is not separated from the base oil. Further, since the vapor pressure of the oily compound is low, the evaporation loss in vacuo is extremely small.

Further, the oily compound contains a substituent having a high polarity at the end of the main chain and thus can be easily adsorbed to the surface of the metal. In other words, since the oily compound is physically or chemically adsorbed to the rolling contact surface and sliding contact surface of the rolling elements, movable member and support member, direct contact of these contact surfaces with each other can be prevented even if these contact surfaces lack the base oil. Accordingly, the use of the oily compound further reduces the coefficient of friction on these contact surfaces, making it possible to prevent abrasion or seizing on these contact surfaces or torque rise more effectively.

The oily compound has a molecular weight of not more than 10,000. If the molecular weight of the oily compound exceeds the above defined upper limit, its adsorptivity to the rolling contact surface or sliding contact surface is reduced, possibly making it impossible to exert an effect of improving lubricity.

Further, the oily compound is preferably incorporated in the lubricant composition in an amount of from 0.5 to 10% by weight. If the content of the oily compound falls below the above defined lower limit, the desired effect of improving lubricity and inhibiting the leakage or scattering of the lubricant may not be exerted. On the contrary, if the content of the oily compound exceeds the above defined upper limit, the resulting lubricant composition exhibits a reduced viscosity that can make the lubricant composition liable to scattering or leakage.

Examples of the oily compound which can be used in the fourth and fifth embodiments include the compounds represented by formulae (2) to (5) described with respect to the first to third embodiments.

The lubricant composition to be used in the rolling apparatus according to any one of the first to fifth embodiments of the present invention as mentioned above may comprise various additives incorporated therein besides the base oil and other components as far as the effects mentioned above cannot be impaired. Examples of the additives to be incorporated in the lubricant composition include an antioxidant, a rustproofing agent, an abrasion inhibitor, a dispersant, a metal protector, and a surface active agent. These additives can be incorporated in a total amount of up to about 15% by weight, though depending on their kinds.

EXAMPLES

The present invention will be further described in the following examples.

Example 1

FIG. 1 is a sectional view illustrating a rolling bearing 1 according to an embodiment of the present invention installed in a rolling bearing rotary testing machine 6. In FIG. 1, the rolling bearing 1 comprises an inner race 2 having a groove-like track provided on the outer circumference and an outer race 4 having a groove-like track provided on the inner circumference disposed coaxially therewith. Disposed rotatably on the track on the inner race 2 and the outer race 4 is a ball 3 which acts as rolling elements. In order to reduce the contact resistance and prevent abrasion on the inner race 2, outer race 4 and ball 3, a lubricant composition 5 is provided in the gap formed by the track on the inner race 2 and the outer race 4.

With the formulation of the lubricant composition 5 varied, the rolling bearing 1 was examined for torque life and dust blowing under the following conditions. In some detail, as the rolling bearing 1 there was used a ball bearing having an inner diameter of 8 mm, an outer diameter of 22 mm and a width of 7 mm produced by NSK, Ltd. (Parts No. 608). Using a bearing rotary testing machine 6, the properties were measured.

The torque life was evaluated by the rotation time between the point at which operation beings and the point at which the torque exceeds a predetermined threshold value. The measurement was conducted un the following conditions:

| | |
|---|---|
| Temperature: | Ordinary temperature |
| Atmosphere: | Atmospheric condition |
| Rotary speed: | 1,000 rpm |
| Axial load: | 196 N |
| Radial load: | 1.96 N |

The dust blowing was evaluated by the number of droplets of the lubricant composition 5 scattered out of the rolling bearing 1 within a predetermined period of time. The bearing rotary testing machine 6 was installed in a Class 100 clean bench. The measurement was conducted under the following conditions:

| | |
|---|---|
| Temperature: | Ordinary temperature |
| Atmosphere: | Atmospheric condition |
| Rotary speed: | 3,000 rpm |
| Axial load: | 19.6 N |

As the bearing rotary testing machine 6 there was used a bearing rotary testing machine produced by NSK, Ltd. In the bearing rotary testing machine 6, the inner race 2 of the rolling bearing 1 is fixed to the rotary axis of a spindle 7, and the axial load on the rolling bearing 1 can be adjusted by a spring 8 or the like. Provided on the spindle 7 is a magnetic fluid seal unit 15. The rotation of the spindle 7 is carried out by transmitting a driving force given by a motor 9 from a pulley 11 to a pulley 12 via a belt 10. On the other hand, the outer race 4 of the rolling bearing 1 is held by a housing 13 connected to a small load converter 14. Accordingly, the torque of the rolling bearing 1 can be measured by means of the small load converter 14.

The rolling bearing 1 is surround by a container 16 and a partition 17. Connected to the bottom of the space thus formed is a laser beam scattering type particle counter 18. On the other hand, provided on the upper part of the space through a filter 20 is an air intake port through which clean air can be supplied into the space.

Accordingly, by supplying clean into the space at a predetermined flow rate, an air stream can be produced from the air intake port 19 to the particle counter 18. In this arrangement, the amount, i.e., number of droplets of the lubricant composition 5 or abrasion powder generated from the rolling bearing 1 can be determined by the particle counter 18.

Table 1 shows the formulation and loaded amount of the various lubricant composition 5 used in the rolling bearing 1, the torque life and the dust blowing.

TABLE 1

| | Sample Nos. | | | | | | | | | | | | | | | Comparative Sample Nos. | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 1 | 2 |
| Base Oil (wt %) | 85 | 69.9 | 67 | 67 | 67 | 67 | 67 | 60 | 60 | 60 | 55 | 55 | 50 | 95 | 96 | 70 | 95 |
| PFPE Oil | | | | | | | | | | | | | | | | | |
| Thickening Agent (wt %) | | | | | | | | | | | | | | | | | |
| PTFE Polymer | 0 | 30 | 30 | 30 | 30 | 30 | 30 | 10 | 20 | 0 | 20 | 0 | 30 | 0 | 3 | 30 | 5 |
| Mica A | 15 | 0.1 | 3 | 0 | 0 | 0 | 0 | 30 | 20 | 40 | 25 | 45 | 20 | 5 | 1 | 0 | 0 |
| Mica B | 0 | 0 | 0 | 3 | 0 | 0 | 0 | 0 | 0 | 0 | 0 | 0 | 0 | 0 | 0 | 0 | 0 |
| Mica C | 0 | 0 | 0 | 0 | 3 | 0 | 0 | 0 | 0 | 0 | 0 | 0 | 0 | 0 | 0 | 0 | 0 |
| Mica D | 0 | 0 | 0 | 0 | 0 | 3 | 0 | 0 | 0 | 0 | 0 | 0 | 0 | 0 | 0 | 0 | 0 |
| Montmorillonite | 0 | 0 | 0 | 0 | 0 | 0 | 3 | 0 | 0 | 0 | 0 | 0 | 0 | 0 | 0 | 0 | 0 |
| Total Amount | 15 | 30.1 | 33 | 33 | 33 | 33 | 33 | 40 | 40 | 40 | 45 | 45 | 50 | 5 | 4 | 30 | 5 |
| Loaded Amount (mg) | 100 | 100 | 100 | 100 | 100 | 100 | 100 | 100 | 100 | 100 | 100 | 100 | 100 | 30 | 30 | 100 | 30 |
| Torque Life (hr.) | 400 | 250 | 400 | 300 | 250 | 200 | 300 | 600 | 500 | 600 | 200 | 250 | 100 | 200 | 100 | 80 | 50 |
| Dust Blowing (number/cf) | 300 | 700 | 200 | 400 | 500 | 500 | 300 | 200 | 200 | 200 | 300 | 250 | 300 | 500 | 100 | 2000 | 1500 |

As PFPE oil set forth in Table 1 there was used S-200 produced by DAIKIN INDUSTRIES, LTD. As PTFE polymer set forth in Table 1 there was used Lublon L-2, produced by DAIKIN INDUSTRIES, LTD. As mica A there was used a Type 4C-TS synthesized mica produced by TOPY INDUSTRIES, LTD. as a swelling mica which has been subjected to hydrophobic treatment. As mica B there was used a Type DMA-350 synthesized mica produced by TOPY INDUSTRIES, LTD. as a swelling mica which has not been subjected to hydrophobic treatment. As mica C there was used a Type PDM-9WA synthesized mica produced by TOPY INDUSTRIES, LTD. as a non-swelling mica which has been subjected to hydrophobic treatment. As mica D there was used a Type CR-TS synthesized mica produced by TOPY INDUSTRIES, LTD. as a non-swelling mica which has not been subjected to hydrophobic treatment. As montmorillonite there was used a Type SPN smectite produced by CO-OP CHEMICAL CO., LTD. The micas A to D and montmorillonite were lamellar minerals. The term "loaded amount" as used herein is meant to indicate the amount of the lubricant composition 5 loaded in the rolling bearing 1.

As can be seen in Table 1, all the rolling bearing samples (1) to (15) according to the examples of the present invention exhibit a prolonged torque life and reduced dust blowing as compared with Comparative Examples (1) and (2) as conventional rolling bearings. Accordingly, the use of a lubricant composition comprising a liquid fluorinated polymer oil and the lamellar mineral powder made it possible to improve torque life and reduce dust blowing.

The comparison of the torque life of Samples (1) to (15) shows that Samples (1) to (12), (14) and (15) exhibit a prolonged torque life as compared with Sample (13). This is probably because all the lubricant compositions used in Samples (1) to (12), (14) and (15) have a thickening agent content of not more than 45% by weight as compared with the lubricant composition 5 used in Sample (13).

The comparison of the dust blowing of Samples (1) to (15) shows that Samples (1) and (3) to (13) exhibit reduced dust blowing as compared with Samples (2), (14) and (15). The fact that Samples (1) and (3) to (13) exhibit reduced dust blowing as compared Sample (2) is probably attributed to the amount of the lamellar mineral powder (mica A, mica B, montmorillonite) in the lubricant composition 5. In other words, if the content of the lamellar mineral powder is great, the lamellar mineral powder is present interposed between the rolling contact surfaces or sliding contact surfaces, and it prevents these contact surfaces from coming in direct contact with each other.

Further, the fact that Samples (1) and (3) to (13) exhibit reduced dust blowing as compared Samples (14) and (15) is probably attributed to the viscosity of the lubricant composition 5. In other words, the lubricant compositions used in Samples (1) and (3) to (13) are grease-like while those used in Samples (14) and (15) are liquids having a low viscosity. The difference in the loaded amount between Samples (14) and (15) and Comparative Sample (2) depends on which the lubricant composition 5 used is grease-like or liquid.

Samples (3) to (7) were prepared in the same manner except that different kinds of lamellar mineral powders were used. The comparison of these samples shows that those comprising micas A and B and montmorillonite provide good results both in torque life and dust blowing as compared with those comprising micas C and D. This is probably because while micas C and D exhibit no swelling properties, micas A and B and montmorillonite exhibit swelling properties, making it possible to keep supplying a proper amount of base oil into the gap between these contact surfaces.

Further, the lubricant composition comprising mica A provides good results both in torque life and dust blowing as compared with that comprising mica B. The lubricant composition comprising mica C provides good results in torque life as compared with that comprising mica D. This is probably because micas A and C have been subjected to hydrophobic treatment unlike micas B and D. In particular, the use of mica A makes it easier to take the base oil thereinto, providing improvements both in torque life and dust blowing.

Example 2

Rolling bearings 1 were produced in the same manner as Sample (3) of Example 1. In some detail, the weight proportion of PFPE oil, PTFE polymer and mica were 67% by weight, 30% by weight and 3% by weight, respectively, and the particle diameter of micas used were varied. As micas there were used the same micas A to C as used in Example 1. The rolling bearings 1 thus produced were then measured for torque life in the same manner as in Example 1. The results are graphically shown in FIG. 2.

Figure 2:
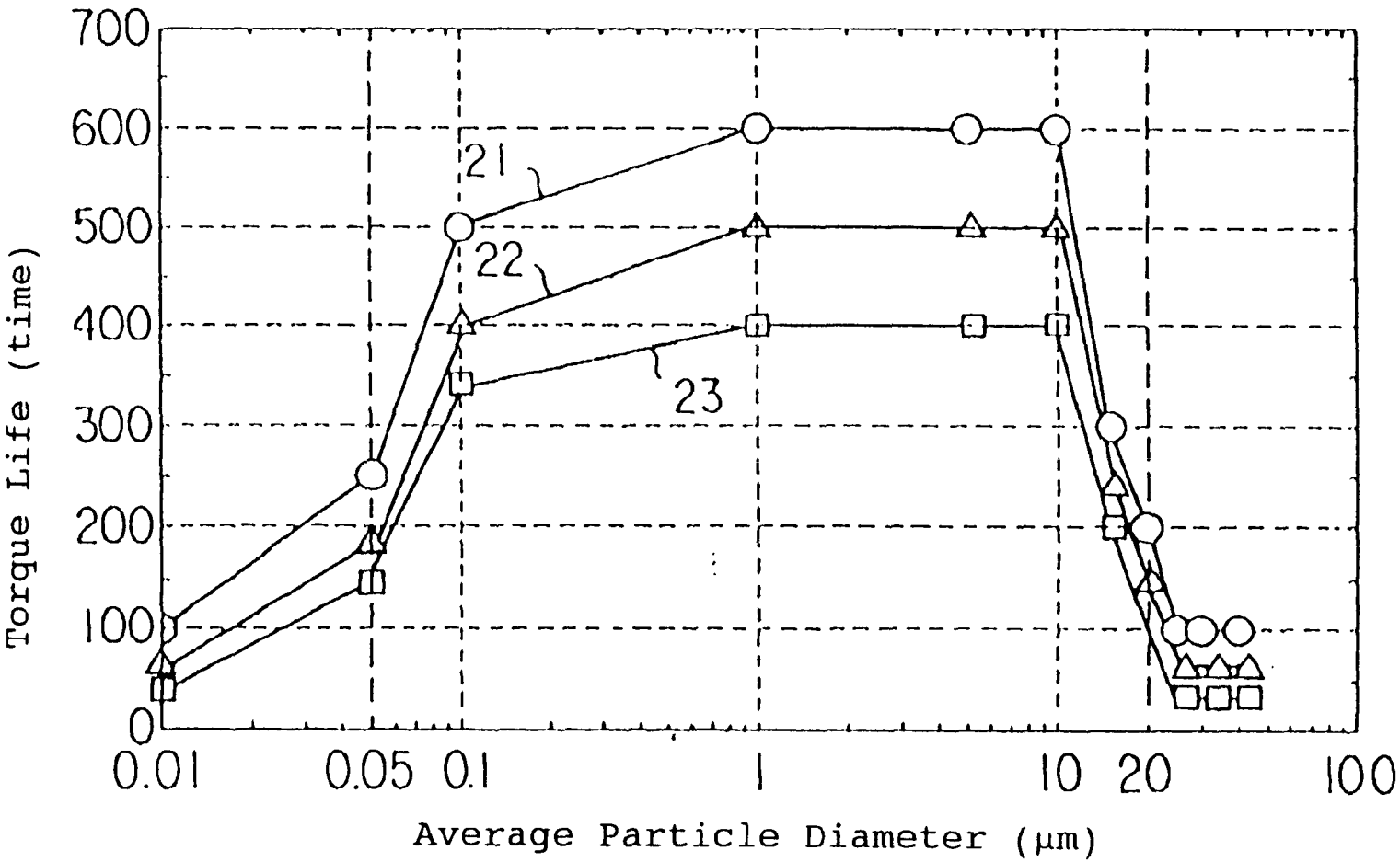
FIG. 2 is a graph illustrating the relationship between the average particle diameter of lamellar mineral powder and the torque life of the rolling apparatus according to the examples of the present invention.

In FIG. 2, the abscissa indicates the average particle diameter of micas A to C, and the ordinate indicates the torque life. In FIG. 2, the curve 21 indicates data obtained with mica A, the curve 22 indicates data obtained with mica B, and the curve 23 indicates data obtained with mica C .

This graph shows that micas A to C provide a prolonged torque life regardless of the range within which their average particle diameter falls. In particular, when the average particle diameter of these micas falls within the range of from 0.05 to 20 $\mu$m, a longer torque life can be provided. For example, the rolling bearing 1 comprising mica A having an average particle diameter of from 0.1 to 10 $\mu$m can exhibit a prolonged torque life as long as more than 500 hours.

Example 3

Rolling bearings 1 were produced in the same manner as Sample (7) of Example 1. In some detail, the content of PFPE oil and micas were varied while the content of PTFE polymer in the lubricant composition was fixed to 20% by weight. As micas there were used the same micas A to C as used in Example 1. The rolling bearings 1 thus produced were then measured for torque life in the same manner as in Example 1. The results are graphically shown in FIG. 3.

Figure 3:
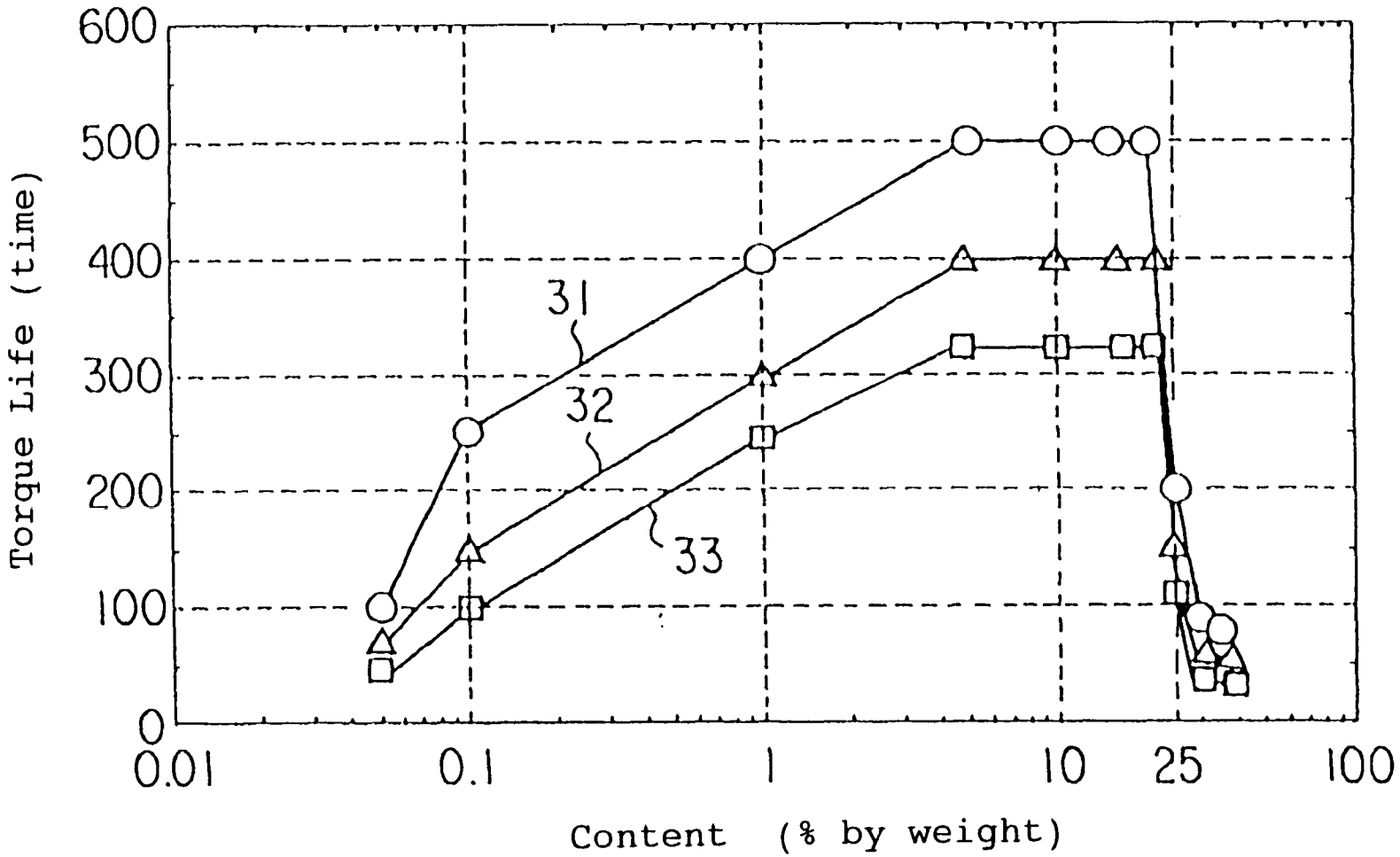
FIG. 3 is a graph illustrating the relationship between the content of lamellar mineral powder in the lubricant composition and the torque life of the rolling apparatus according to the examples of the present invention.

In FIG. 3, the abscissa indicates the content of micas A to C in the lubricant composition, and the ordinate indicates the torque life. In FIG. 3, the curve 31 indicates data obtained with mica A, the curve 32 indicates data obtained with mica B, and the curve 33 indicates data obtained with mica C.

This graph shows that micas A to C provide a relatively long torque life regardless of the range within which their average content falls. When the content of mica A falls within the range of from 0.1 to 25% by weight, i.e., the content of thickening agent, which is the sum of the content of solid fluorinated polymer (PTFE polymer) and mica A, falls within the range of from 20.1 to 45% by weight, a longer torque life can be provided.

Example 4

Rolling bearings 1 were produced by varying the mixing proportion of PFPE oil and mica A in the same manner as Sample (1) of Example 1 except that the loaded amount of the lubricant composition was 30 mg. In some detail, the lubricant composition 5 was prepared from a mixture of PFPE oil and mica A free of PTFE polymer. The mixing proportion of PFPE oil and mica A was varied. The rolling bearings 1 thus produced were then measured for torque life and dust blowing in the same manner as in Example 1. The results are graphically shown in FIG. 4.

Figure 4:
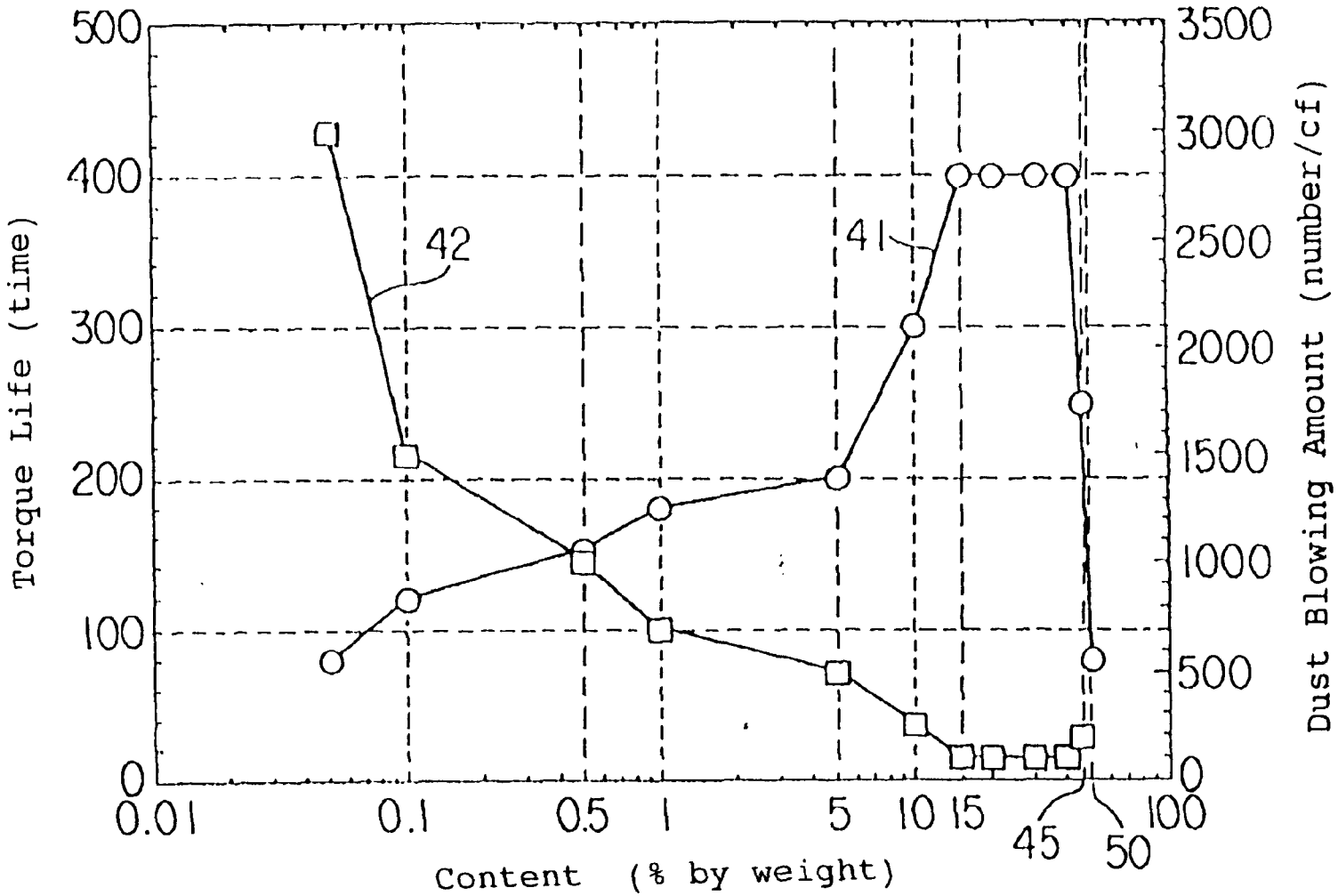
FIG. 4 is a graph illustrating the relationship between the content of lamellar mineral powder in the lubricant composition and the torque life and dust blowing in the rolling apparatus according to the examples of the present invention.

In FIG. 4, the abscissa indicates the content of mica A in the lubricant composition, and the ordinate indicates the torque life and dust blowing. In FIG. 4, the curve 41 indicates data of torque life, and the curve 42 indicates data of dust blowing.

This graph shows that when the content of mica A is not less than 0.1% by weight, reduced dust blowing can be provided. The greater (but not greater than 45% by weight) the weight proportion of mica is, the longer is the resulting torque life. In other words, when the content of the lamellar mineral powder such as mica A powder falls within the range of from 0.1 to 45% by weight based on the base oil such as PFPE, good results can be provided with respect to torque life and dust blowing.

Further, when the content of mica A falls within the range of from 5 to 45% by weight, better properties can be provided. Best properties can be provided particularly when the content of mica A falls within the range of from 15 to 45% by weight. This is probably because when the content of mica A is not less than 5% by weight, the resulting lubricant composition stays grease-like or in between grease-like and liquid, and when the content of mica A is not less than 15% by weight, the resulting lubricant composition stays completely grease-like while when the content of mica A falls below 5% by weight, the resulting lubricant composition stays liquid.

Example 5

Rolling bearings 1 were produced in the same manner as in Example 1 except that the lubricant composition comprised an inorganic material incorporated therein instead of the lamellar mineral powder. The rolling bearings 1 were then measured for torque life and dust blowing. Table 2 shows the formulation and loaded amount of the various lubricant composition 5 used in the rolling bearing 1, the torque life and the dust blowing.

TABLE 2

| | Sample Nos. | | | | | | | Comparative Sample Nos. | |
|---|---|---|---|---|---|---|---|---|---|
| | 16 | 17 | 18 | 19 | 20 | 21 | 22 | 1 | 2 |
| Base Oil (wt %) | 67 | 67 | 67 | 67 | 67 | 60 | 60 | 70 | 95 |
| PFPE Oil | | | | | | | | | |
| Thickening Agent (wt %) | | | | | | | | | |
| PTFE polymer | 30 | 30 | 30 | 30 | 30 | 30 | 30 | 30 | 5 |
| $C_{60}$ | 3 | 0 | 0 | 0 | 0 | 0 | 0 | 0 | 0 |
| CD | 0 | 3 | 0 | 0 | 0 | 0 | 0 | 0 | 0 |
| CGD | 0 | 0 | 3 | 0 | 0 | 0 | 0 | 0 | 0 |

TABLE 2-continued

| | Sample Nos. | | | | | | | Comparative Sample Nos. | |
|---|---|---|---|---|---|---|---|---|---|
| | 16 | 17 | 18 | 19 | 20 | 21 | 22 | 1 | 2 |
| $SiO_2$ | 0 | 0 | 0 | 3 | 0 | 0 | 0 | 0 | 0 |
| $TiO_2$ | 0 | 0 | 0 | 0 | 3 | 0 | 0 | 0 | 0 |
| ZrO | 0 | 0 | 0 | 0 | 0 | 3 | 0 | 0 | 0 |
| MgO | 0 | 0 | 0 | 0 | 0 | 0 | 3 | 0 | 0 |
| Total Amount | 33 | 33 | 33 | 33 | 33 | 33 | 33 | 30 | 5 |
| Loaded Amount (mg) | 100 | 100 | 100 | 100 | 100 | 100 | 100 | 100 | 30 |
| Torque Life (hr) | 450 | 350 | 400 | 250 | 230 | 230 | 200 | 80 | 50 |
| Dust Blowing (number/cf) | 250 | 300 | 300 | 350 | 350 | 350 | 350 | 2000 | 1500 |

As fullerence ($C_{60}$) set forth in Table 2 there was used Pure C60, produced by Materials and Electrochemical Research Corporation. As the particulate diamond (CD) there was used MYPOMEX, produced by Du Pont Inc. As the particulate diamond chemically coated with graphite on the surface thereof (CGD) there was used one having an average particle diameter of 200 Å. As silicon oxide ($SiO_2$) there was used AEROSIL 200, produced by Nipon Aerosil Co., Ltd. As titanium oxide ($TiO_2$) there was used Idemitsu Titania IT-UD, produced by Idemitsu Kosan K.K. As zirconia oxide (ZrO) there was used ZrO, produced by C.I. Kasei Co., Ltd. As magnesium oxide (MgO) there was used 100A, produced by Ube Industries, Ltd.

Table 2 shows that all the rolling bearings of Samples (16) to (22) according to the examples of the present invention exhibit a prolonged torque life and reduced dust blowing as compared with Comparative Samples (1) and (2), which are conventional rolling bearings. Accordingly, the use of a lubricant composition comprising a liquid fluorinated polymer oil and the ultrafinely particulate inorganic material makes it possible to improve torque life and reduce dust blowing.

The comparison of the torque life of Samples (16) to (22) shows that Samples (16) to (18) exhibit a prolonged torque life and reduced dust blowing as compared with Samples (19) to (22). This is probably because Samples (16) to (18) comprise as ultrafinely particulate inorganic material, fullerece ($C_{60}$), particulate diamond or particulate diamond chemically coated with graphite on the surface thereof.

Example 6

Rolling bearings 1 were produced in the same manner as Samples (16) to (22) of Example 5. In some detail, the content of PFPE oil and ultrafinely particulate inorganic material were varied while the content of PTFE polymer in the lubricant composition was fixed to 20% by weight. As the ultrafinely particulate inorganic materials there were used the same materials as used in Example 5, i.e., fullerence ($C_{60}$), particulate diamond chemically coated with graphite on the surface thereof, silicon oxide and titanium oxide. The rolling bearings 1 thus produced were then measured for torque life in the same manner as in Example 1. The results are graphically shown in FIG. 5.

In FIG. 5, the abscissa indicates the content of ultrafinely particulate inorganic material in the lubricant composition, and the ordinate indicates the torque life. In FIG. 5, the curve 51 indicates data obtained with fullerence ($C_{60}$), and the curve 52 indicates data obtained with particulate diamond chemically coated with graphite on the surface thereof. The curve 53 indicates data obtained with silicon oxide, and the curve 54 indicates data obtained with titanium oxide.

This graph shows that a relatively long torque life can be provided regardless of the range within which the content of ultrafinely particulate inorganic material falls. In particular, when the content of ultrafinely particulate inorganic material falls within the range of from 0.1 to 20% by weight, i.e., the content of thickening agent, which is the sum of the content of solid fluorinated polymer (PTFE polymer) and ultrafinely particulate inorganic material, falls within the range of from 20.1 to 40% by weight, a longer torque life can be provided.

Example 7

Rolling bearings 1 were produced in the same manner as in Example 1 except that the lubricant composition comprised a PFPE carboxylic acid incorporated therein as an oily compound. The rolling bearings 1 thus produced were measured for torque life under atmospheric pressure and in vacuo ($1\times10^{-4}$ Pa). Table 3 shows the formulation and loaded amount of the various lubricant composition 5 used in the rolling bearing 1, the torque life and the dust blowing.

TABLE 3

| | Sample Nos. | | | | | | | | Comparative Sample Nos. | |
|---|---|---|---|---|---|---|---|---|---|---|
| | 23 | 24 | 25 | 26 | 27 | 28 | 29 | 30 | 1 | 2 |
| Base oil (wt %) | 90 | 67 | 64 | 64 | 64 | 64 | 64 | 64 | 70 | 100 |
| PFPE Oil | | | | | | | | | | |
| Thickening Agent (wt %) | | | | | | | | | | |
| PTFE polymer | 0 | 30 | 30 | 30 | 30 | 30 | 30 | 30 | 30 | 0 |
| Mica A | 0 | 0 | 3 | 0 | 0 | 0 | 0 | 0 | 0 | 0 |

TABLE 3-continued

| | Sample Nos. | | | | | | | | Comparative Sample Nos. | |
|---|---|---|---|---|---|---|---|---|---|---|
| | 23 | 24 | 25 | 26 | 27 | 28 | 29 | 30 | 1 | 2 |
| $C_{60}$ | 0 | 0 | 0 | 3 | 0 | 0 | 0 | 0 | 0 | 0 |
| CD | 0 | 0 | 0 | 0 | 3 | 0 | 0 | 0 | 0 | 0 |
| CGD | 0 | 0 | 0 | 0 | 0 | 3 | 0 | 0 | 0 | 0 |
| $SiO_2$ | 0 | 0 | 0 | 0 | 0 | 0 | 3 | 0 | 0 | 0 |
| $TiO_2$ | 0 | 0 | 0 | 0 | 0 | 0 | 0 | 3 | 0 | 0 |
| Total Amount | 0 | 30 | 33 | 33 | 33 | 33 | 33 | 33 | 30 | 0 |
| PFPE Carboxylic Acid (wt %) | 10 | 3 | 3 | 3 | 3 | 3 | 3 | 3 | 0 | 0 |
| Loaded Amount (mg) | 30 | 100 | 100 | 100 | 100 | 100 | 100 | 100 | 100 | 30 |
| Torque Life (hr) | | | | | | | | | | |
| Atmospheric Pressure | 70 | 100 | 350 | 400 | 320 | 360 | 200 | 200 | 70 | 40 |
| Vacuum | 250 | 300 | 600 | 650 | 500 | 550 | 430 | 400 | 80 | 50 |

Mica A set forth in Table 3 was the same as used in Example 1. Fullerence ($C_{60}$), particulate diamond (CD), particulate diamond chemically coated with graphite on the surface thereof, silicon oxide ($SiO_2$) and titanium oxide ($TiO_2$) set forth in Table 3 were the same as used in Example 5. As PFPE carboxylic acid set forth in Table 3 there was used a compound represented by the general formula (1) wherein n represents a number of from 5 to 80.

Table 3 shows that the rolling bearings of Samples (23) to (30) according to the examples of the present invention exhibit the same or longer torque life under atmospheric pressure than Comparative Samples (1) and (3), which are conventional rolling bearings. In other words, the use of a lubricant composition comprising a liquid fluorinated polymer oil and the PFPE carboxylic acid makes it possible to improve the torque life under atmospheric pressure.

The rolling bearings of Samples (23) to (30) according to the examples of the present invention exhibit far longer torque life in vacuo than Comparative Samples (1) and (3), which are conventional rolling bearings. In other words, the use of a lubricant composition comprising a liquid fluorinated polymer oil and the PFPE carboxylic acid makes it possible to improve the torque life in vacuo.

Example 8

Rolling bearings 1 were produced by preparing a lubricant composition from PFPE oil and PFPE carboxylic acid and varying the content of PFPE carboxylic acid in the same manner as in Example 7 except that the loaded amount of the lubricant composition was 30 mg. Further, rolling bearings 1 were produced by preparing a lubricant composition from PFPE oil and 20% by weight of PFPE polymer and PFPE carboxylic acid and varying the content of PFPE oil and PFPE carboxylic acid in the same manner as in Example 7 except that the loaded amount of the lubricant composition was 100 mg.

The rolling bearings 1 thus produced were then measured for torque life in vacuo and dust blowing under atmospheric pressure in the same manner as in Example 1. The results are graphically shown in FIG. 6.

In FIG. 6, the abscissa indicates the content of PFPE carboxylic acid in the lubricant composition, and the ordinate indicates torque life and dust blowing. In FIG. 6, the curves 61 and 62 indicate data of torque life and dust blowing obtained with the lubricant composition composed of PFPE oil and PFPE carboxylic acid, respectively. The curves 63 and 64 indicate data of torque life and dust blowing obtained with the lubricant composition composed of PFPE oil, PFPE polymer and PFPE carboxylic acid, respectively.

This graph shows that dust blowing can be reduced and a relatively long torque life can be provided regardless of the range within which the content of PFPE carboxylic acid falls. In particular, when the content of ultrafinely particulate inorganic material falls within the range of from 0.1 to 10% by weight, dust blowing can be further reduced and torque life can be further prolonged.

Example 9

Rolling bearings 1 were produced by preparing a lubricant composition from PFPE oil, PFPE polymer, ultrafinely particulate inorganic material and PFPE carboxylic acid and varying the content of PFPE oil and PFPE carboxylic acid in the same manner as in Example 7 except that the content of PFPE polymer and ultrafinely particulate inorganic material were 20% by weight and 3% by weight, respectively. As the ultrafinely particulate inorganic material there was used the same fullerence ($C_{60}$) or particulate diamond chemically coated with graphite on the surface thereof as used in Example 7.

The rolling bearings 1 thus produced were then measured for torque life and dust blowing under atmospheric pressure and in vacuo. The results are graphically shown in FIG. 7.

Figure 7:
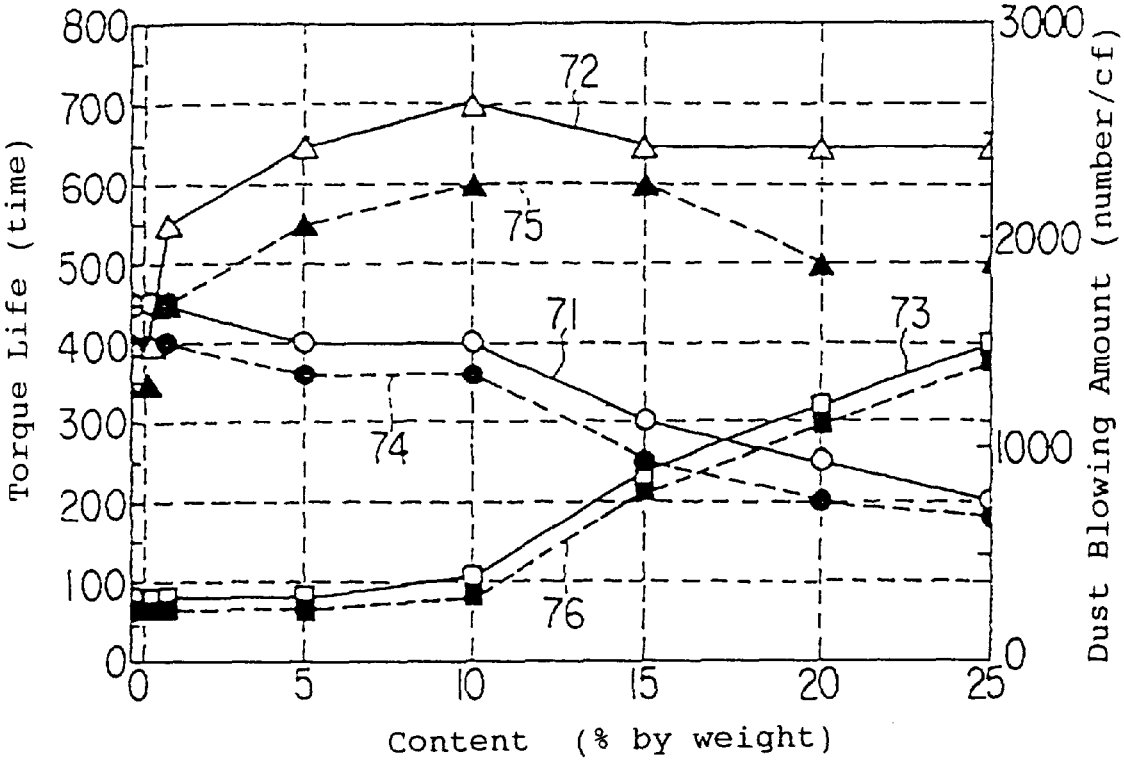
FIG. 7 is a graph illustrating the relationship between the content of PFPE carboxylic acid in the lubricant composition and the torque life and dust blowing in the rolling apparatus according to the examples of the present invention.

In FIG. 7, the abscissa indicates the content of PFPE carboxylic acid in the lubricant composition and the ordinate indicates torque life and dust blowing. In FIG. 7, the curves 71, 72 and 73 indicate data of torque life under atmospheric pressure and in vacuo and dust blowing under atmospheric pressure obtained with fullerence ($C_{60}$) as ultrafinely particulate inorganic material, respectively. The curves 74, 75 and 76 indicate data of torque life under atmospheric pressure and in vacuo and dust blowing under atmospheric pressure obtained with the particulate diamond as ultrafinely particulate inorganic material, respectively.

This graph shows that when the content of PFPE carboxylic acid falls within the range of from 0.1 to 10% by weight, a prolonged torque life can be provided and dust blowing can be reduced both in vacuo and under atmospheric pressure.

Example 10

Rolling bearings 1 were produced by preparing a lubricant composition from PFPE oil, PFPE polymer, the same mica A as used in Example 1 and PFPE carboxylic acid and varying the content of PFPE oil and PFPE carboxylic acid in the same manner as in Example 7 except that the content of PFPE polymer and mica A were 20% by weight and 3% by weight, respectively. Further, rolling bearings 1 were produced by preparing a lubricant composition from PFPE oil, PFPE polymer, particulate silicon oxide and PFPE carboxylic acid and varying the content of PFPE oil and PFPE carboxylic acid in the same manner as in Example 7 except that the content of PFPE polymer and particulate silicon oxide were 20% by weight and 3% by weight, respectively.

The rolling bearings 1 thus produced were then measured for torque life and dust blowing under atmospheric pressure and in vacuo in the same manner as in Example 1. The results are graphically shown in FIG. 8.

Figure 8:
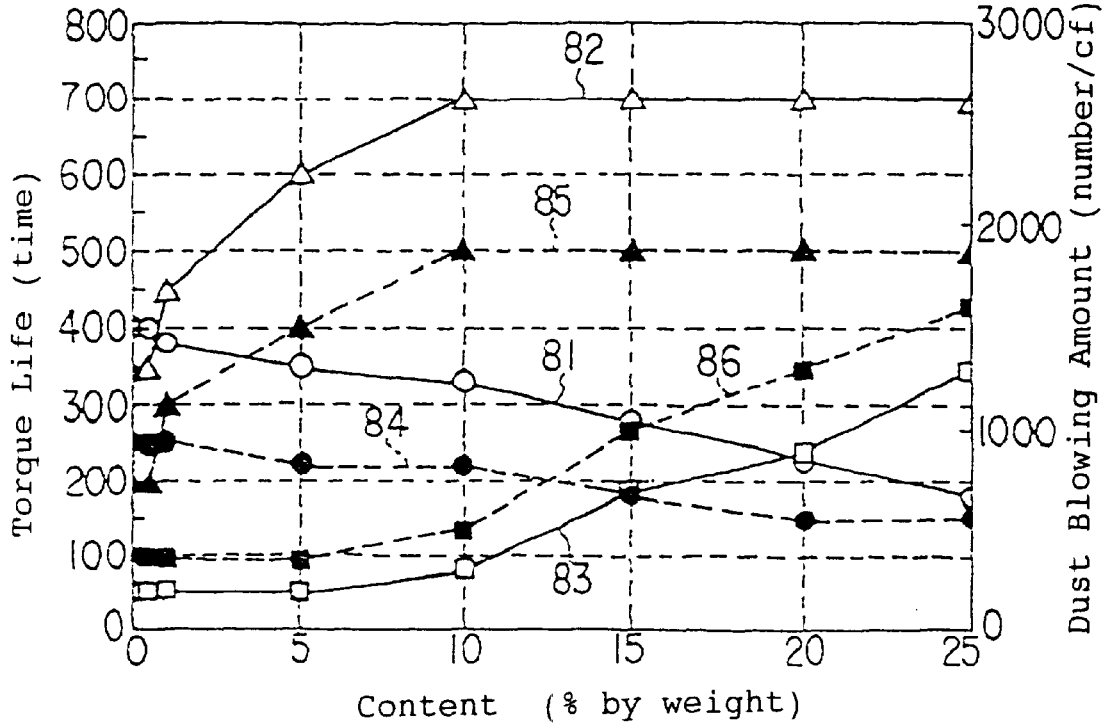
FIG. 8 is a graph illustrating the relationship between the content of PFPE carboxylic acid in the lubricant composition and the torque life and dust blowing in the rolling apparatus according to the examples of the present invention.

In FIG. 8, the abscissa indicates the content of PFPE carboxylic acid in the lubricant composition and the ordinate indicates torque life and dust blowing. In FIG. 8, the curves 81, 82 and 83 indicate data of torque life under atmospheric pressure and in vacuo and dust blowing under atmospheric pressure obtained with mica A as ultrafinely particulate inorganic material, respectively. The curves 84, 85 and 86 indicate data of torque life under atmospheric pressure and in vacuo and dust blowing under atmospheric pressure obtained with particulate silicon oxide as ultrafinely particulate inorganic material, respectively.

This graph shows that when the content of PFPE carboxylic acid falls within the range of from 0.1 to 10% by weight, a prolonged torque life can be provided and dust blowing can be reduced both in vacuo and under atmospheric pressure.

The examples have been described mainly with reference to the use of PFPE oil as a base oil. However, similar effects can be exerted when other liquid fluorinated polymer oils are used. The examples have also been described with reference to the case where the rolling apparatus of the present invention is used as a rolling bearing. However, similar effects can be exerted when the rolling apparatus of the present invention is used as a direct-acting apparatus such as ball screw apparatus and linear guide.

Example 11

FIG. 1 is a sectional view illustrating a rolling bearing 1 according to an embodiment of the present invention installed in a rolling bearing rotary testing machine 6. In FIG. 1, the rolling bearing 1 comprises an inner ring 2 having a groove-like track provided on the periphery thereof and an outer ring 4 having a groove-like track provided on the inner wall thereof disposed coaxially therewith. Disposed rotatably on the track on the inner ring 2 and the outer ring 4 is a ball 3 which acts as a rolling element. In order to reduce the contact resistance and prevent abrasion on the inner ring 2, outer ring 4 and ball 3, a lubricant composition 5 is provided in the gap formed by the track on the inner ring 2 and the outer ring 4. The inner ring 2, the outer ring 4 and the ball 3 are made of SUS440C. A corrugated retainer and a shield plate which are not shown are made of SUS304.

With the formulation of the lubricant composition 5 varied, the rolling bearing 1 was examined for torque life and dust blowing under the following conditions. In some detail, as the rolling bearing 1 there was used a ball bearing having an inner diameter of 8 mm, an outer diameter of 22 mm and a width of 7 mm produced by NSK, Ltd. (Parts No. 608). Using a bearing rotary testing machine as shown in FIG. 1, the properties were measured in the same manner as in Examples 1 to 10.

The following table shows the formulation and loaded amount of the various lubricant composition 5 used in the rolling bearing 1, the torque life of the rolling bearing 1 with the various lubricant composition 5 and the dust blowing from the rolling bearing 1 with the various lubricant composition 5.

TABLE 4

| | Sample Nos. | | | | | | | | | | | | Comparative Sample Nos. | |
|---|---|---|---|---|---|---|---|---|---|---|---|---|---|---|
| | 1 | 2 | 3 | 4 | 5 | 6 | 7 | 8 | 9 | 10 | 11 | 12 | 1 | 2 |
| Base Oil (wt %) | 85 | 69.9 | 70 | 70 | 70 | 65 | 60 | 55 | 55 | 50 | 95 | 96 | 70 | 95 |
| PFPE Oil | | | | | | | | | | | | | | |
| Thickening Agent (wt %) | | | | | | | | | | | | | | |
| PTFE Polymer | 0 | 25 | 25 | 25 | 0 | 10 | 20 | 20 | 0 | 30 | 0 | 3 | 30 | 5 |
| Ultrafinely Particulate Organic Material A | 15 | 0.1 | 5 | 0 | 30 | 25 | 20 | 25 | 45 | 20 | 5 | 1 | 0 | 0 |
| Ultrafinely Particulate Organic Material B | 0 | 0 | 0 | 5 | 0 | 0 | 0 | 0 | 0 | 0 | 0 | 0 | 0 | 0 |
| Total Amount | 15 | 25.1 | 30 | 30 | 33 | 35 | 40 | 45 | 45 | 50 | 5 | 4 | 30 | 5 |
| Loaded Amount (mg) | 100 | 100 | 100 | 100 | 100 | 100 | 100 | 100 | 100 | 100 | 30 | 30 | 100 | 30 |
| Torque Life (hr.) | 430 | 280 | 450 | 400 | 600 | 600 | 500 | 250 | 300 | 130 | 250 | 170 | 80 | 50 |
| Dust Blowing (number/cf) | 250 | 500 | 200 | 250 | 200 | 200 | 200 | 250 | 220 | 280 | 450 | 800 | 2000 | 1500 |

As PFPE oil set forth in Table 4 there was used S-200 produced by DAIKIN INDUSTRIES, LTD. As PTFE polymer set forth in Table 4 there was used Lublon L-2, produced by DAIKIN INDUSTRIES, LTD. As the ultrafinely particulate organic material A there was used Nippe Microgel P5000, produced by NIPPON PAINT CO, LTD. As the ultrafinely particulate organic material B there was used Nippe Microgel P1800, produced by NIPPON PAINT CO, LTD. The term "loaded amount" as used herein is meant to indicate the amount of the lubricant composition 5 loaded in the rolling bearing 1.

As can be seen in Table 4, all the rolling bearing samples (1) to (12) according to the examples of the present invention exhibit a prolonged torque life and reduced dust blowing as compared with Comparative Examples (1) and (2) as conventional rolling bearings. Accordingly, the use of a lubricant composition comprising a liquid fluorinated polymer oil and the ultrafinely particulate organic material made it possible to improve torque life and reduce dust blowing.

The comparison of the torque life of Samples (1) to (12) shows that Samples (1) to (9), (11) and (12) exhibit a prolonged torque life as compared with Sample (10). This is probably because all the lubricant compositions used in Samples (1) to (9), (11) and (12) exhibit a thickening agent content of not more than 45% by weight as compared with the lubricant composition 5 used in Sample (10).

The comparison of the dust blowing of Samples (1) to (12) shows that Samples (1) and (3) to (10) exhibit reduced dust blowing as compared with Samples (2), (11) and (12). The fact that Samples (1) and (3) to (10) exhibit reduced dust blowing as compared Sample (2) is probably attributed to the amount of the ultrafinely particulate organic material (ultrafinely particulate organic materials A and B) in the lubricant composition 5. In other words, if the content of the ultrafinely particulate organic material is great enough, the ultrafinely particulate organic material takes the base oil thereinto to swell, minimizing the scattering of the base oil.

Further, the fact that Samples (1) and (3) to (10) exhibit reduced dust blowing as compared Samples (11) and (12) is probably attributed to the viscosity of the lubricant composition 5. In other words, the lubricant compositions used in Samples (1) and (3) to (10) are grease-like while those used in Samples (11) and (12) are liquids having a low viscosity. The difference in the loaded amount between Samples (11) and (12) and Comparative Sample (2) and the other samples depends on which the lubricant composition 5 used is grease-like or liquid.

Example 12

Rolling bearings 1 were produced in the same manner as Sample (3) of Example 11. In some detail, the weight proportion of PFPE oil, PTFE polymer and ultrafinely particulate organic material were 70% by weight, 25% by weight and 5% by weight, respectively, and the particle diameter of ultrafinely particulate organic materials used were varied. As ultrafinely particulate organic materials there were used the same ultrafinely particulate organic materials A and B as used in Example 11. The rolling bearings 1 thus produced were then measured for torque life under atmospheric pressure in the same manner as in Example 11. The results are graphically shown in FIG. 9.

Figure 9:
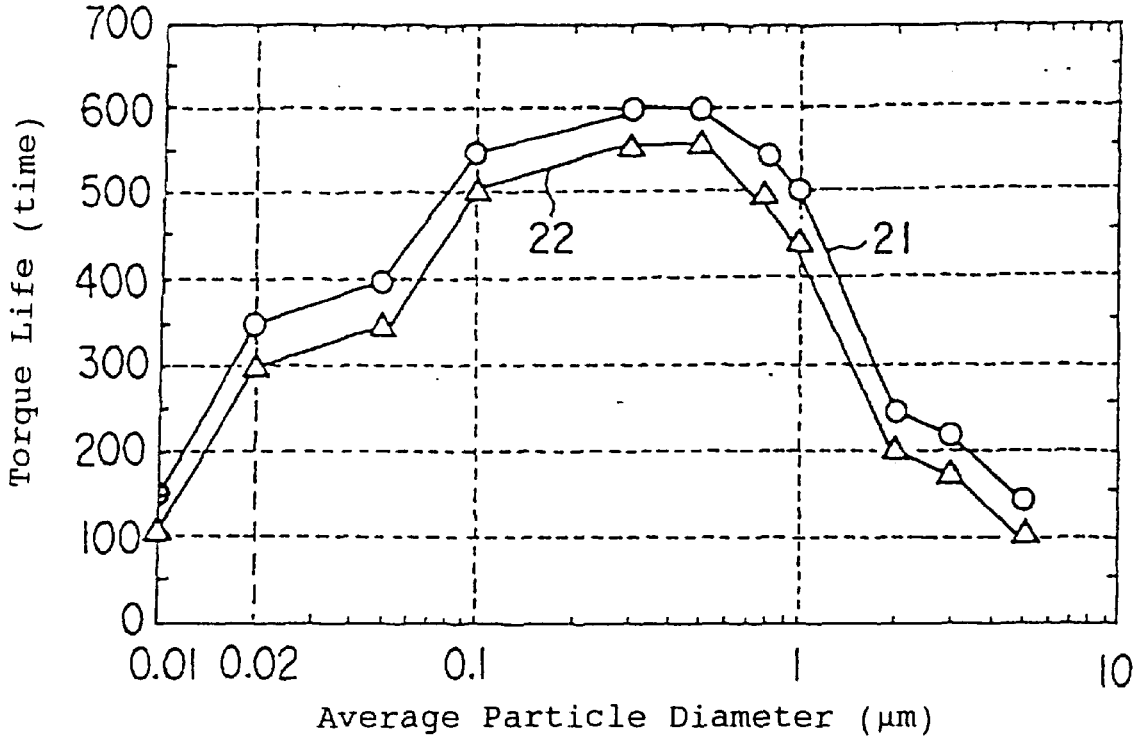
FIG. 9 is a graph illustrating the relationship between the average particle diameter of ultrafinely particulate organic material and the torque life in the rolling apparatus according to the examples of the present invention.

In FIG. 9, the abscissa indicates the average particle diameter of ultrafinely particulate organic materials A and B, and the ordinate indicates the torque life under atmospheric pressure. In FIG. 9, the curve 21 indicates data obtained with ultrafinely particulate organic material A, and the curve 22 indicates data obtained with ultrafinely particulate organic material B. This graph shows that ultrafinely particulate organic material A and B provide a prolonged torque life regardless of the range within which their average particle diameter falls. In particular, when the average particle diameter of these ultrafinely particulate organic materials falls within the range of from 20 nm to 1 $\mu$m, a longer torque life can be provided.

Example 13

Rolling bearings 1 were produced in the same manner as Sample (7) of Example 11. In some detail, the content of PFPE oil and ultrafinely particulate organic materials were varied while the content of PTFE polymer in the lubricant composition was fixed to 20% by weight. As ultrafinely particulate organic materials there were used the same ultrafinely particulate organic materials A and B as used in Example 11. The rolling bearings 1 thus produced were then measured for torque life under atmospheric pressure in the same manner as in Example 11. The results are graphically shown in FIG. 10.

Figure 10:
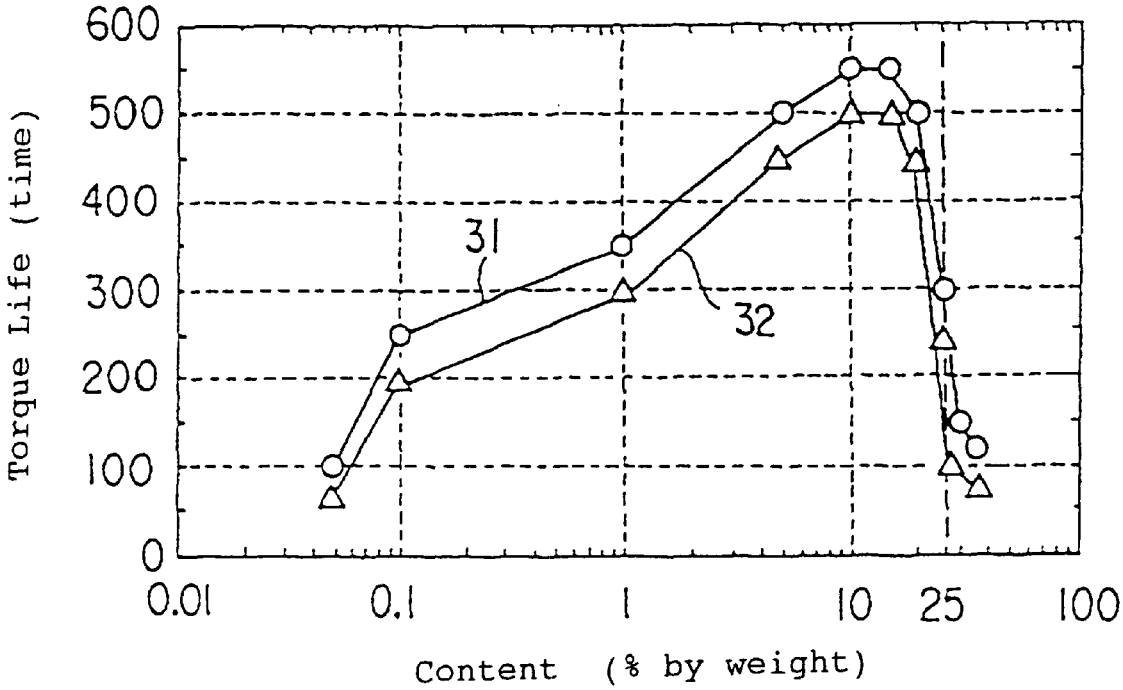
FIG. 10 is a graph illustrating the relationship between the content of ultrafinely particulate organic material in the lubricant composition and the torque life in the rolling apparatus according to the examples of the present invention.

In FIG. 10, the abscissa indicates the content of ultrafinely particulate organic material A and B in the lubricant composition, and the ordinate indicates the torque life under atmospheric pressure. In FIG. 10, the curve 31 indicates data obtained with ultrafinely particulate organic material A, and the curve 32 indicates data obtained with ultrafinely particulate organic material B. This graph shows that ultrafinely particulate organic materials A and B provide a relatively long torque life regardless of the range within which their average content falls. When the content of ultrafinely particulate organic materials A and B falls within the range of from 0.1 to 25% by weight, i.e., the content of thickening agent, which is the sum of the content of solid fluorinated polymer (PTFE polymer) and ultrafinely particulate organic material A or B, falls within the range of from 20.1 to 45% by weight, a longer torque life can be provided.

Example 14

Rolling bearings 1 were produced by varying the mixing proportion of PFPE oil and ultrafinely particulate organic material A in the same manner as Sample (1) of Example 11 except that the loaded amount of the lubricant composition was 30 mg. In some detail, the lubricant composition 5 was prepared from a mixture of PFPE oil and ultrafinely particulate organic material A free of PTFE polymer. The mixing proportion of PFPE oil and ultrafinely particulate organic material A was varied. Further, rolling bearings 1 were produced by varying the mixing proportion of PFPE oil and ultrafinely particulate organic material B in the same manner as above except that ultrafinely particulate organic material B was used instead of ultrafinely particulate organic material A. The mixing proportion of PFPE oil and ultrafinely particulate organic material B was varied. The rolling bearings 1 thus produced were then measured for torque life and dust blowing under atmospheric pressure in the same manner as in Example 11. The results are graphically shown in FIG. 11.

Figure 11:
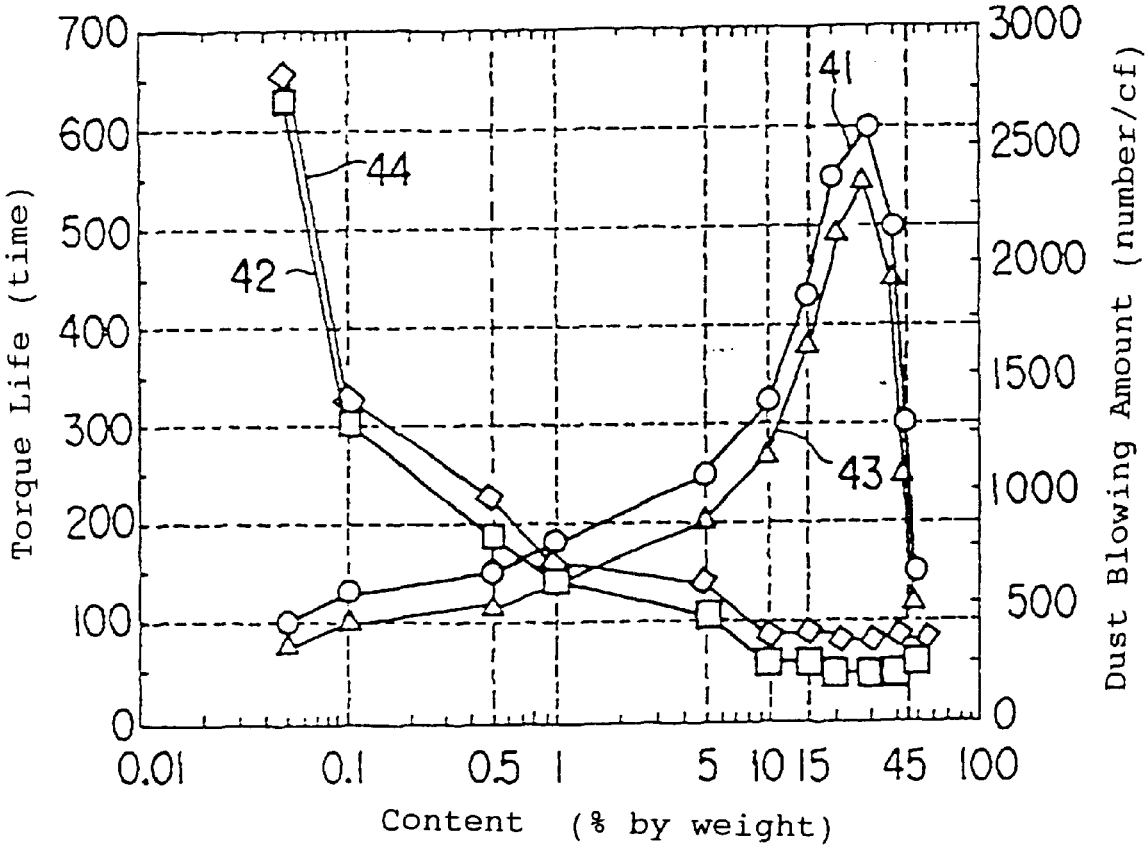
FIG. 11 is a graph illustrating the relationship between the content of ultrafinely particulate organic material in the lubricant composition and the torque life and dust blowing in the rolling apparatus according to the examples of the present invention.

In FIG. 11, the abscissa indicates the content of ultrafinely particulate organic materials A and B in the lubricant composition, and the ordinate indicates the torque life and dust blowing under atmospheric pressure. In FIG. 11, the curve 41 indicates data of torque life obtained with ultrafinely particulate organic material A, the curve 42 indicates data of dust blowing obtained with ultrafinely particulate organic material A, the curve 43 indicates data of torque life obtained with ultrafinely particulate organic material B, and the curve 44 indicates data of dust blowing obtained with ultrafinely particulate organic material B.

This graph shows that when the content of ultrafinely particulate organic material A or B is not less than 0.1% by weight, reduced dust blowing can be provided. The greater (but not greater than 45% by weight) the weight proportion of ultrafinely particulate organic material A or B is, the longer is the resulting torque life. In other words, when the content of the ultrafinely particulate organic material such as ultrafinely particulate organic materials A and B falls within the range of from 0.1 to 45% by weight based on the base oil such as PFPE, good results can be provided with respect to torque life and dust blowing.

Further, when the content of ultrafinely particulate organic material A or B falls within the range of from 5 to 45% by weight, better properties can be provided. Best properties can be provided particularly when the content of ultrafinely particulate organic material A or B falls within the range of from 15 to 45% by weight. This is probably because when the content of ultrafinely particulate organic material A or B is not less than 5% by weight, the resulting lubricant composition stays grease-like or in between grease-like and liquid, and when the content of ultrafinely particulate organic material A or B is not less than 15% by weight, the resulting lubricant composition stays completely grease-like while when the content of ultrafinely particulate organic material A or B falls below 5% by weight, the resulting lubricant composition stays liquid.

Example 15

Rolling bearings 1 were produced in the same manner as in Example 11 except that the lubricant composition comprised a white powder incorporated therein instead of the ultrafinely particulate organic material. The rolling bearings 1 were then measured for torque life and dust blowing. Table 5 shows the formulation and loaded amount of the various lubricant compositions 5 used in the rolling bearing 1, the torque life and the dust blowing.

TABLE 5

| | Sample Nos. | | | | Comparative Sample Nos. | |
|---|---|---|---|---|---|---|
| | 13 | 14 | 15 | 16 | 1 | 2 |
| Base Oil (wt %) | 70 | 70 | 70 | 70 | 70 | 95 |
| PFPE oil | | | | | | |
| Thickening Agent (wt %) | | | | | | |
| PTFE Polymer | 25 | 25 | 25 | 25 | 30 | 5 |
| Amino Acid Compound | 5 | 0 | 0 | 0 | 0 | 0 |
| Melamine Cyanurate | 0 | 5 | 0 | 0 | 0 | 0 |
| Carbon Fluoride A | 0 | 0 | 5 | 0 | 0 | 0 |
| Carbon Fluoride B | 0 | 0 | 0 | 5 | 0 | 0 |
| Total Amount (wt %) | 30 | 30 | 30 | 30 | 30 | 5 |
| Loaded Amount (mg) | 100 | 100 | 100 | 100 | 100 | 30 |
| Torque Life (hr) | 350 | 250 | 280 | 250 | 80 | 50 |
| Dust Blowing (number/cf) | 350 | 400 | 350 | 400 | 2000 | 1500 |

As the amino acid compound (N-lauroyl.L-lysine) having a lamellar crystal structure set forth in Table 5 there was used Famex L-12J (produced by Ajinomoto Co., Inc.). As the melamine cyanurate there was used one produced by Mitsubishi Chemical Corporation. As the carbon fluoride A there was used a particulate material represented by the general formula $(CF)_n$ having an average particle diameter of 3 $\mu$m. As the carbon fluoride B there was used a particulate material represented by the general formula (CF) having an average particle diameter of 4 $\mu$m.

Table 5 shows that all the rolling bearings of Samples (13) to (16) according to the examples of the present invention exhibit a prolonged torque life and reduced dust blowing as compared with Comparative Samples (1) and (2), which are conventional rolling bearings. Accordingly, the use of a lubricant composition comprising a liquid fluorinated polymer oil and the white powder makes it possible to improve torque life and reduce dust blowing.

Example 16

Rolling bearings 1 were produced in the same manner as Samples (13) to (16) of Example 15. In some detail, the content of PFPE oil and white powder were varied while the content of PTFE polymer in the lubricant composition was fixed to 20% by weight. As the ultrafinely particulate organic materials there were used the same materials as used in Example 15, i.e., N-lauroyl.L-lysine, melamine cyanurate, carbon fluoride A and carbon fluoride B. The rolling bearings 1 thus produced were then measured for torque life under atmospheric pressure in the same manner as in Example 11. The results are graphically shown in FIG. 12.

Figure 12:
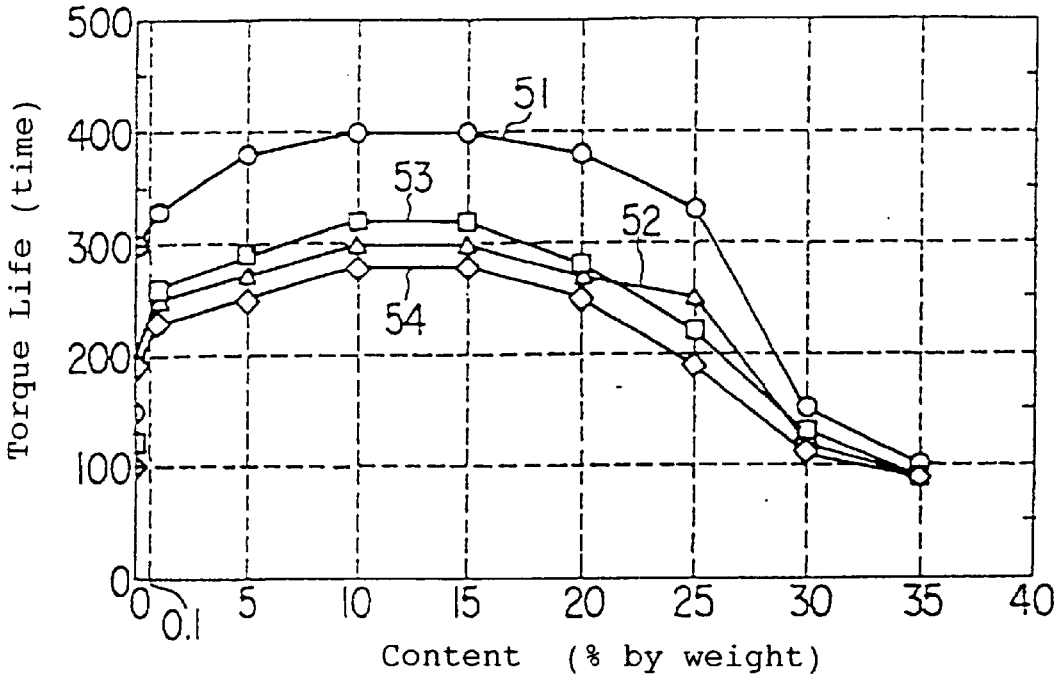
FIG. 12 is a graph illustrating the relationship between the content of white powder in the lubricant composition and the torque life in the rolling apparatus according to the examples of the present invention.

In FIG. 12, the abscissa indicates the content of white powder in the lubricant composition, and the ordinate indicates the torque life under atmospheric pressure. In FIG. 12, the curve 51 indicates data obtained with N-lauroyl.L-lysine, and the curve 52 indicates data obtained with melamine cyanurate. The curve 53 indicates data obtained with carbon fluoride A, and the curve 54 indicates data obtained with carbon fluoride B.

FIG. 12 shows that a relatively long torque life can be provided regardless of the range within which the content of white powder falls. In particular, when the content of white powder falls within the range of from 0.1 to 25% by weight, i.e., the content of thickening agent, which is the sum of the content of solid fluorinated polymer (PTFE polymer) and white powder, falls within the range of from 20.1 to 45% by weight, a longer torque life can be provided.

Example 17

Rolling bearings 1 were produced in the same manner as in Example 11 and 15 except that the lubricant composition comprised a PFPE carboxylic acid incorporated therein as an oily compound. The rolling bearings 1 thus produced were measured for torque life under atmospheric pressure and in vacuo ($1\times10^{-4}$ Pa). Table 6 shows the formulation and loaded amount of the various lubricant compositions 5 used in the rolling bearing 1, and the torque life.

TABLE 6

| | Sample No. | | | | | | | | | | | | Comparative Sample No. |
|---|---|---|---|---|---|---|---|---|---|---|---|---|---|
| | 17 | 18 | 19 | 20 | 21 | 22 | 23 | 24 | 25 | 26 | 27 | 28 | 1 |
| Base Oil | 69 | 69 | 69 | 69 | 69 | 69 | 66 | 66 | 66 | 66 | 66 | 66 | 70 |
| PFPE Oil | | | | | | | | | | | | | |
| Thickening Agent (wt %) | | | | | | | | | | | | | |
| PTFE Polymer | 25 | 25 | 25 | 25 | 25 | 25 | 25 | 25 | 25 | 25 | 25 | 25 | 30 |
| Ultrafinely Particulate Organic Material A | 3 | 0 | 0 | 0 | 0 | 0 | 3 | 0 | 0 | 0 | 0 | 0 | 0 |

TABLE 6-continued

| | Sample No. | | | | | | | | | | | | Comparative Sample No. |
|---|---|---|---|---|---|---|---|---|---|---|---|---|---|
| | 17 | 18 | 19 | 20 | 21 | 22 | 23 | 24 | 25 | 26 | 27 | 28 | 1 |
| Ultrafinely Particulate Organic Material B | 0 | 3 | 0 | 0 | 0 | 0 | 0 | 3 | 0 | 0 | 3 | 3 | 0 |
| Amino Acid Compound | 0 | 0 | 3 | 0 | 0 | 0 | 3 | 3 | 3 | 3 | 0 | 0 | 0 |
| Melamine Cyanurate | 0 | 0 | 0 | 3 | 0 | 0 | 0 | 0 | 0 | 3 | 0 | 0 | 0 |
| Carbon Fluoride A | 0 | 0 | 0 | 0 | 3 | 0 | 0 | 0 | 3 | 0 | 3 | 0 | 0 |
| Carbon Fluoride B | 0 | 0 | 0 | 0 | 0 | 3 | 0 | 0 | 0 | 0 | 0 | 3 | 0 |
| Total Amount (wt %) | 28 | 28 | 28 | 28 | 28 | 28 | 31 | 31 | 31 | 31 | 31 | 31 | 30 |
| Loaded Amount (mg) | 100 | 100 | 100 | 100 | 100 | 100 | 100 | 100 | 100 | 100 | 100 | 100 | 100 |
| Torque Life (hr) | | | | | | | | | | | | | |
| Atmospheric Pressure | 400 | 380 | 320 | 210 | 250 | 220 | 500 | 550 | 450 | 400 | 430 | 400 | 70 |
| Vacuum | 300 | 350 | 600 | 500 | 350 | 300 | 650 | 700 | 500 | 650 | 500 | 550 | 80 |

The ultrafinely particulate organic materials A and B set forth in Table 6 were the same as used in Example 11. The amino acid compound, melamine cyanurate, carbon fluoride A and carbon fluoride B were the same as used in Example 15. As PFPE carboxylic acid set forth in Table 6 there was used PFPE carboxylic acid SH produced by DAIKIN INDUSTRIES, LTD. Table 6 shows that the rolling bearings of Samples (17) to (28) according to the examples of the present invention exhibit far longer torque life under atmospheric pressure and in vacuo than Comparative Sample (1), which is conventional rolling bearing. In other words, the use of a lubricant composition containing an ultrafinely particulate organic material or white powder having the PFPE carboxylic acid incorporated therein makes it possible to drastically improve the torque life under atmospheric pressure as well as in vacuo.

Example 18

Rolling bearings 1 were produced by preparing a lubricant composition from PFPE oil, 20% by weight of PFPE polymer, 3% by weight of an ultrafinely particulate organic material and PFPE carboxylic acid and varying the content of PFPE oil and PFPE carboxylic acid in the same manner as Samples (17) and (18) of Example 17. As the ultrafinely particulate organic material there was used the same ultrafinely particulate organic material A or B as used in Example 11.

The rolling bearings 1 thus produced were then measured for torque life under atmospheric pressure and in vacuo and dust blowing under atmospheric pressure in the same manner as in Example 11. The results are graphically shown in FIG. 13.

Figure 13:
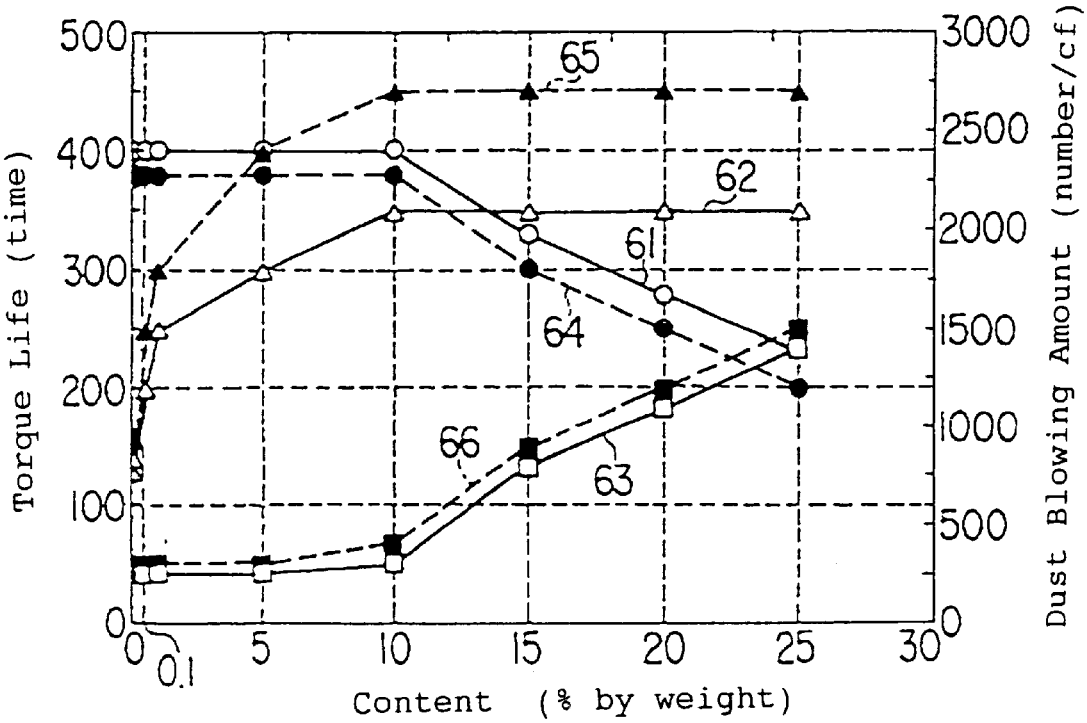
FIG. 13 is a graph illustrating the relationship between the content of PFPE carboxylic acid in the lubricant composition and the torque life and dust blowing in the rolling apparatus according to the examples of the present invention.

In FIG. 13, the abscissa indicates the content of PFPE carboxylic acid in the lubricant composition, and the ordinate indicates torque life and dust blowing. In FIG. 13, the curves 61 and 62 indicate data of torque life under atmospheric pressure and in vacuo obtained with the lubricant composition containing ultrafinely particulate organic material A, respectively. The curves 64 and 65 indicate data of torque life under atmospheric pressure and in vacuo obtained with the lubricant composition containing ultrafinely particulate organic material B, respectively. The curve 63 indicates data of dust blowing obtained with the lubricant composition containing ultrafinely particulate organic material A, and the curve 66 indicates data of dust blowing obtained with the lubricant composition containing ultrafinely particulate organic material B.

This graph shows that when the content of PFPE carboxylic acid falls within the range of from 0.1 to 10% by weight, a good torque life can be provided both in vacuo and under atmospheric pressure, and dust blowing can be further reduced.

Example 19

Rolling bearings 1 were produced by preparing a lubricant composition from PFPE oil, 20% by weight of PFPE polymer, 3% by weight of white powder and PFPE carboxylic acid and varying the content of PFPE oil and PFPE carboxylic acid in the same manner as Samples (19) and (21) of Example 17. As the white powder there was used the same amino acid compound and carbon fluoride A as used in Example 15.

The rolling bearings 1 thus produced were then measured for torque life in vacuo and under atmospheric pressure and dust blowing under atmospheric pressure. The results are graphically shown in FIG. 14.

Figure 14:
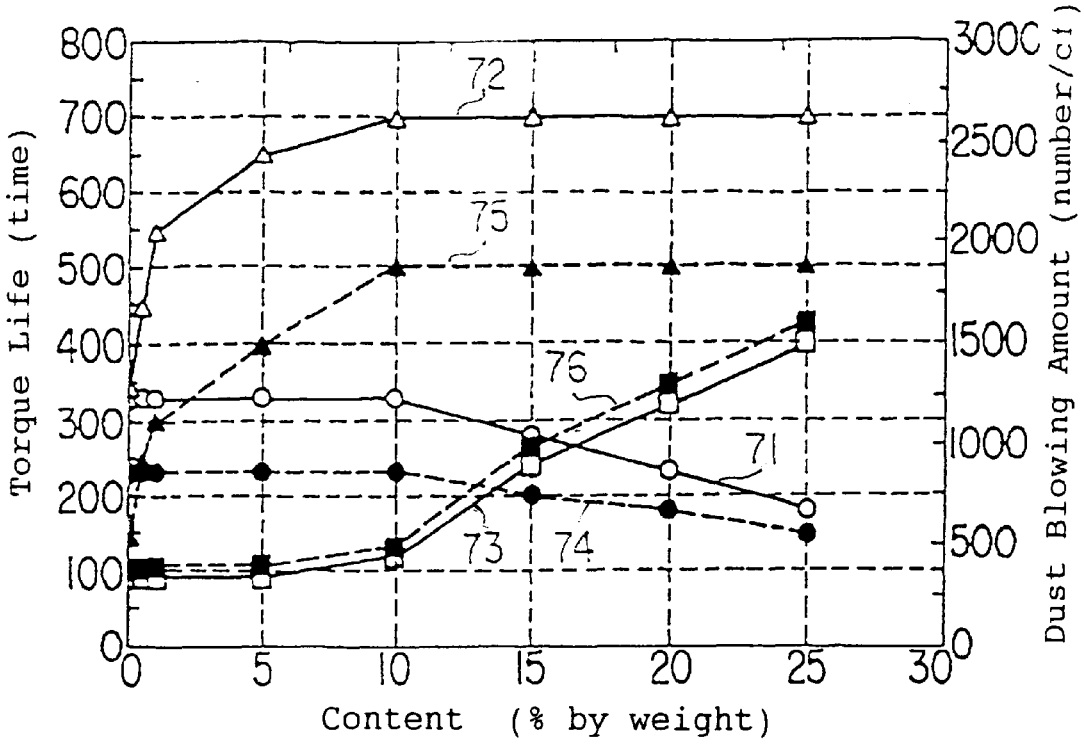
FIG. 14 is a graph illustrating the relationship between the content of PFPE carboxylic acid in the lubricant composition and the torque life and dust blowing in the rolling apparatus according to the examples of the present invention.

In FIG. 14, the abscissa indicates the content of PFPE carboxylic acid in the lubricant composition, and the ordinate indicates torque life and dust blowing. In FIG. 14, the curves 71 and 72 indicate data of torque life under atmospheric pressure and in vacuo obtained with the lubricant composition containing an amino acid compound, respectively, and the curves 74 and 75 indicate data of torque life under atmospheric pressure and in vacuo obtained with the lubricant composition containing carbon fluoride A, respectively. The curve 73 indicates data of dust blowing obtained with the lubricant composition containing an amino acid compound, and the curve 76 indicates data of dust blowing obtained with the lubricant composition containing carbon fluoride A.

This graph shows that when the content of PFPE carboxylic acid falls within the range of from 0.1 to 10% by weight, a prolonged torque life can be provided both in vacuo and under atmospheric pressure and dust blowing can be further reduced.

Example 20

Rolling bearings 1 were produced by preparing a lubricant composition from PFPE oil, 20% by weight of PFPE polymer, ultrafinely particulate organic material and 3% by weight of PFPE carboxylic acid and varying the content of PFPE oil and white powder in the same manner as mentioned with reference to Sample (24) of Example 17. In some detail, as the ultrafinely particulate organic material there was used ultrafinely particulate organic material B. As the white powder there was used N-lauroyl.L-lysine. Further, rolling bearings 1 were produced in the same manner as mentioned above except that the content of ultrafinely particulate organic material B was 1% by weight and 3% by weight, respectively.

The rolling bearings 1 thus produced were then measured for torque life under atmospheric pressure and in vacuo in the same manner as in Example 11. The results are graphically shown in FIG. 15.

Figure 15:
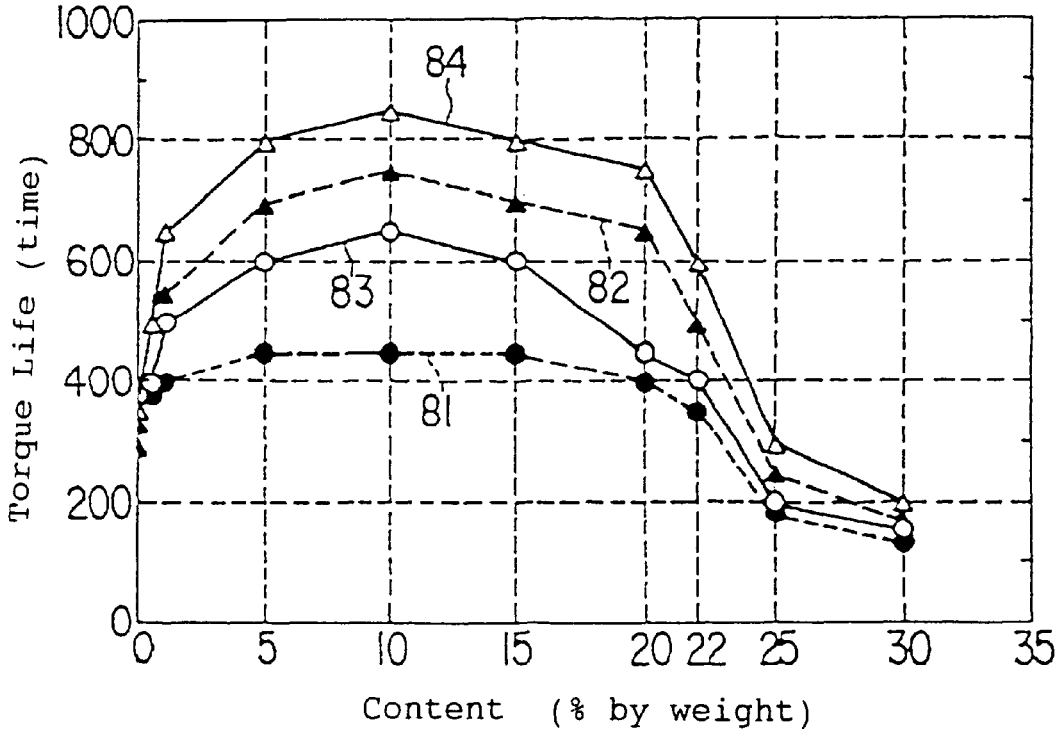
FIG. 15 is a graph illustrating the relationship between the content of white powder in the lubricant composition and the torque life and dust blowing in the rolling apparatus according to the examples of the present invention.

In FIG. 15, the abscissa indicates the content of white powder in the lubricant composition, and the ordinate indicates torque life. In FIG. 15, the curves 81 and 82 indicate data of torque life under atmospheric pressure and in vacuo obtained with the lubricant composition comprising ultrafinely particulate organic material B in an amount of 1% by weight, respectively. The curves 83 and 84 indicate data of torque life under atmospheric pressure and in vacuo obtained with the lubricant composition comprising ultrafinely particulate organic material B in an amount of 3% by weight, respectively.

This graph shows that when the content of white powder falls within the range of from 0.1 to 22% by weight, that is, the content of thickening agent, which is the sum of solid fluorinated polymer (PTFE polymer), ultrafinely particulate organic material and white powder, falls within the range of from 23.1 to 45% by weight, a prolonged torque life can be provided can be reduced both in vacuo and under atmospheric pressure.

The examples have been described mainly with reference to the use of PFPE oil as a base oil. However, similar effects can be exerted when other liquid fluorinated polymer oils are used. The examples have also been described with reference to the case where the rolling apparatus of the present invention is used as a rolling bearing. However, similar effects can be exerted when the rolling apparatus of the present invention is used as a direct-acting apparatus such as ball screw apparatus and linear guide.

As mentioned above, the rolling apparatus of the first to third embodiments according to the present invention comprises as a lubricant composition a mixture of a thickening agent containing a lamellar mineral powder and a base oil composed of a liquid fluorinated polymer oil. Alternatively, the rolling apparatus of the present invention comprises as a lubricant composition a mixture of a thickening agent containing an ultrafinely particulate inorganic material and a base oil composed of a liquid fluorinated polymer oil. Further, the rolling apparatus of the present invention comprises as a lubricant composition one comprising a perfluoropolyether carboxylic acid having a molecular weight of not more than 10,000 incorporated in a base oil composed of a liquid fluorinated polymer oil or a grease composition comprising a perfluoropolyether carboxylic acid having a molecular weight of not more than 10,000 incorporated in a mixture of a base oil composed of a liquid fluorinated polymer oil and a thickening agent containing a solid fluorinated polymer.

The use of these lubricant compositions makes it possible to reduce the scattering of lubricant composition or abrasion on the rolling apparatus or the like. Accordingly, the present invention provides a rolling apparatus which exhibits a reduced dust blowing and a prolonged torque life.

The rolling apparatus of fourth and fifth embodiments according to the present invention comprises as a lubricant composition a mixture of a thickening agent containing an ultrafinely particulate organic material having swelling properties and a base oil composed of a liquid fluorinated polymer oil or a mixture of a thickening agent containing a white powder composed of a non-metallic element and a base oil composed of a liquid fluorinated polymer oil. In this arrangement, the scattering of the lubricant composition or the abrasion of the rolling elements or the like can be reduced, making it possible to reduce dust blowing and provide a prolonged torque life. Accordingly, the rolling apparatus of the present invention rarely contaminates the external atmosphere even under atmospheric pressure or in vacuo and can be operated over an extended period of time. Thus, the rolling apparatus of the present invention is suitable for use in purposes requiring clean atmosphere such as semiconductor production apparatus and liquid crystal panel production apparatus. Further, the rolling apparatus of the present invention can be used in severe atmospheres where a normal lubricant or grease cannot be used, such as high temperature, vacuum and extremely low temperature.

While the invention has been described in detail and with reference to specific embodiments thereof, it will be apparent to one skilled in the art that various changes and modifications can be made therein without departing from the spirit and scope thereof.

What is claimed is:

1. A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of:

(1) a thickening agent which is a fluoro-mica-based lamellar mineral particle containing at least one of a lithium ion and a sodium ion as an interlaminar ion or a mixture of said lamellar mineral particle and a solid fluoropolymer particle, and (2) a base oil comprising a liquid fluorinated polymer oil having a perfluoropolyether skeleton and no polar group, and an oily compound having a perfluoropolyether skeleton as a main chain and a polar group at either or both ends of the main chain and having a molecular weight of not more than 10,000 in an amount of from 0.5 to 10% by weight based on the lubricant composition.

2. A rolling apparatus, comprising:

a movable member which can undergo rotary or linear motion, a support member which carries the moveable member, rolling elements which are interposed between the moveable member and the support member and which roll with the movement of the movable member, and a lubricant composition which is disposed between the movable member on which the rolling elements roll and the support member, wherein the lubricant composition is a mixture of:

(1) a thickening agent which is a fluoro-mica-based lamellar mineral particle containing at least one of a lithium ion and a sodium ion as an interlaminar ion or a mixture of said lamellar mineral particle and a solid fluoropolymer particle, and (2) a base oil comprising a liquid fluorinated polymer oil having a perfluoropolyether skeleton and no polar group, wherein the lubricant composition contains the thickening agent in an amount of 0.1 to 45% by weight and the base oil in an amount of 55 to 95% by weight.

3. The rolling apparatus according to claim 1 or 2, wherein the lubricant composition contains the lamellar mineral particle having an average particle diameter of 0.05 to 20 $\mu$m in an amount of 1 to 45% by weight.

4. The rolling apparatus according to claim 1, wherein the lubricant composition comprises the oily compound consisting of a perfluoropolyether carboxylic acid having a molecular weight of not more than 10,000 in an amount of from 0.5 to 10% by weight.

5. The rolling apparatus according to claim 1 or 2, wherein the lamellar mineral particle is covered with a surface active agent containing an alkyl group having 8 or more carbon atoms for hydrophobic treatment.

6. The rolling apparatus according to claim 1 or 2, wherein the lubricant composition contains the lamellar mineral particle in an amount of 0.1 to 45% by weight.

7. The rolling apparatus according to claim 1 or 2, wherein the lubricant composition contains the lamellar mineral particle in an amount of 1.0 to 45% by weight.

8. The rolling apparatus according to claim 1 or 2, wherein the lamellar mineral particle has an average particle diameter of 0.05 to 20 $\mu$m.

9. A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, and an oily compound having a perfluoropolyether skeleton as a main chain and a polar group at either or both ends of the main chain and having a molecular weight of not more than 10,000 in a amount of from 0.5 to 10% by weight based on the lubricant composition, wherein the lubricant composition contains at least one of the organic particle comprising a cross-linked polymer and the organic particle having a lamellar crystal structure in an amount of 1 to 45% by weight.

10. A rolling apparatus, comprising:

a movable member which can undergo rotary or linear motion, a support member which carries the moveable member, rolling elements which are interposed between the moveable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, wherein the lubricant composition contains the thickening agent in an amount of 0.1 to 45% by weight and the base oil in an amount of 55 to 95% by weight, wherein the lubricant composition contains at least one of the organic particle comprising a cross-linked polymer and the organic particle having a lamellar crystal structure in an amount of 1 to 45% by weight.

11. The rolling apparatus according to claim 9 or 10, wherein the organic particle comprising a cross-linked polymer is spherical and hydrophobic.

12. The rolling apparatus according to claim 9 or 10, wherein the organic particle having a lamellar crystal structure has white lamellar crystal structure and is at least one selected from the group consisting of an amino acid compound, melamine cyanurate and a carbon fluoride.

13. The rolling apparatus according to claim 9 or 10, wherein the organic particle having a lamellar crystal structure has an average particle diameter of 0.05 to 20 $\mu$m.

14. A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, and an oily compound having a perfluoropolyether skeleton as a main chain and a polar group at either or both ends of the main chain and having a molecular weight of not more than 10,000 in a amount of from 0.5 to 10% by weight based on the lubricant composition, wherein the lubricant composition contains at least one of the organic particle comprising a cross-linked polymer, wherein said organic particle has an average particle diameter of 20 nm to 1 μm.

15. A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, and an oily compound having a perfluoropolyether skeleton as a main chain and a polar group at either or both ends of the main chain and having a molecular weight of not more than 10,000 in a amount of from 0.5 to 10% by weight based on the lubricant composition, wherein the lubricant composition contains at least one of the organic particle comprising a cross-linked polymer, wherein said organic particle is a particulate polymer and is at least one selected from the group consisting of a polymer or copolymer of acrylic acid ester, a polymer or copolymer of methacrylic acid ester, a styrene polymer, and a styrene acryl copolymer.

16. A rolling apparatus comprising:

a movable member which can undergo rotary or linear motion, a support member which carries the movable member, rolling elements which are interposed between the movable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, and an oily compound having a perfluoropolyether skeleton as a main chain and a polar group at either or both ends of the main chain and having a molecular weight of not more than 10,000 in a amount of from 0.5 to 10% by weight based on the lubricant composition, wherein the lubricant composition contains at least one of the organic particle comprising a cross-linked polymer, wherein said organic particle is a particulate polymer and is a styrene-methacrylic acid ester copolymer.

17. A rolling apparatus, comprising:

a movable member which can undergo rotary or linear motion, a support member which carries the moveable member, rolling elements which are interposed between the moveable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, wherein the lubricant composition contains the thickening agent in an amount of 0.1 to 45% by weight and the base oil in an amount of 55 to 95% by weight, wherein the lubricant composition contains at least one of the organic particle comprising a cross-linked polymer, wherein said organic particle has an average particle diameter of 20 nm to 1 μm.

18. A rolling apparatus, comprising:

a movable member which can undergo rotary or linear motion, a support member which carries the moveable member, rolling elements which are interposed between the moveable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, wherein the lubricant composition contains the thickening agent in an amount of 0.1 to 45% by weight and the base oil in an amount of 55 to 95% by weight, wherein the lubricant composition contains at least one of the organic particle comprising a cross-linked polymer, wherein said organic particle is a particulate polymer and is at least one selected from the group consisting of a polymer or copolymer of acrylic acid ester, a polymer or copolymer of methacrylic acid ester, a styrene polymer, and a styrene-acryl copolymer.

19. A rolling apparatus, comprising:

a movable member which can undergo rotary or linear motion, a support member which carries the moveable member, rolling elements which are interposed between the moveable member and the support member and which roll with the movement of the movable member, and a lubricant composition which is disposed between the movable member on which the rolling elements roll and the support member, wherein the lubricant composition is a mixture of:

(1) a thickening agent which is at least one selected from the group consisting of a solid fluoropolymer particle, a lamellar mineral particle, an organic particle comprising a cross-linked polymer, an organic particle having a lamellar crystal structure, and an inorganic particle, and (2) a base oil comprising a liquid fluorinated polymer oil having a perfluoropolyether skeleton and no polar group, wherein the lubricant composition contains the thickening agent in an amount of 0.1 to 45% by weight and the base oil in an amount of 55 to 95% by weight, wherein the lubricant composition contains at least one of the organic particle comprising a cross-linked polymer, wherein said organic particle is a particulate polymer and is a styrene-methacrylic acid ester copolymer.

* * * * *